US006189989B1

(12) United States Patent
Hirabayashi et al.

(10) Patent No.: US 6,189,989 B1
(45) **Date of Patent: *Feb. 20, 2001**

(54) EMBROIDERING USING INK JET PRINTING APPARATUS

(75) Inventors: Hiromitsu Hirabayashi, Yokohama; Hiroyuki Miyake, Kawasaki; Sadayuki Sugama, Tsukuba; Tetsuro Inoue; Miyuki Matsubara, both of Tokyo, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/927,262

(22) Filed: Sep. 11, 1997

Related U.S. Application Data

(63) Continuation of application No. 08/679,998, filed on Jul. 15, 1996, now abandoned, which is a continuation of application No. 08/225,781, filed on Apr. 11, 1994, now abandoned.

(30) Foreign Application Priority Data

Apr. 12, 1993 (JP) ..... 5-084680
Apr. 23, 1993 (JP) ..... 5-098154

(51) Int. Cl.[7] ..... B41J 3/00; B41J 3/407; B41J 2/21; B05D 5/00

(52) U.S. Cl. ..... 347/4; 347/106; 347/43; 427/288

(58) Field of Search ..... 8/149, 151.2, 152; 118/107, 101; 28/163, 164, 165, 169; 346/140.1; 68/205 R; 101/72; 427/170, 288; 347/116, 101, 85, 43, 44, 55

(56) References Cited

U.S. PATENT DOCUMENTS

| | | | | |
|---|---|---|---|---|
| 3,021,815 | * | 2/1962 | Burke et al. | 347/2 |
| 3,570,275 | * | 3/1971 | Weber et al. | 347/106 |
| 3,863,310 | * | 2/1975 | Ochsner | 28/77 |
| 4,029,006 | * | 6/1977 | Mercer | 347/4 |
| 4,116,626 | * | 9/1978 | Varner | 347/4 |
| 4,465,005 | * | 8/1984 | Eguchi et al. | 112/270 |
| 4,503,437 | * | 3/1985 | Katzschner | 347/106 |
| 4,670,761 | * | 6/1987 | Yoshino et al. | 346/75 |
| 4,725,849 | * | 2/1988 | Koike et al. | 347/106 |
| 5,191,360 | * | 3/1993 | Pohlig | 346/140 |
| 5,444,466 | * | 8/1995 | Smyczek et al. | 347/4 |
| 5,594,485 | * | 1/1997 | Koike et al. | 347/106 |

FOREIGN PATENT DOCUMENTS 59-137096 8/1984 (JP) .

* cited by examiner

*Primary Examiner*—John E. Barlow, Jr.
*Assistant Examiner*—Raquel Yvette Gordon
(74) *Attorney, Agent, or Firm*—Fitzpatrick, Cella, Harper & Scinto

(57) ABSTRACT

An ink jet printing apparatus has a station for dyeing a thread for embroidering by discharging ink onto the thread from an ink jet head. According to one aspect of the invention, a printing controller controls the amount of ink discharged per unit time onto the thread according to the speed of relative movement of the thread and the ink jet head. Another aspect of the invention accounts for the length of non-usable thread per unit time between an ink jet printing unit and the tip of an embroidery needle in an embroidery machine.

41 Claims, 16 Drawing Sheets

EMBROIDERING USING INK JET PRINTING APPARATUS

This application is a continuation of application Ser. No. 08/679,998 filed Jul. 15, 1996, now abandoned, which is a continuation of application Ser. No. 08/225,781 filed Apr. 11, 1994, now abandoned.

BACKGROUND OF THE INVENTION

1. Field of the Invention

The present invention relates to ink jet printing and, more particularly, to ink jet printing for dyeing embroidery thread and to embroidering using thread dyed by ink jet printing.

2. Related Background Art

Apparatus for embroidering a medium such as cloth in accordance with a design generated using a personal computer is known. Such apparatus is advantageous in that it is easy to generate the design and embroidering a complex design can be readily accomplished.

However, the color of the embroidered design depends on the color of thread in the embroidery apparatus. Therefore, when embroidery is carried out using different color threads, the thread used in the apparatus must be changed each time a different color is to be embroidered. To change the thread, the thread currently in the apparatus must be cut and removed, and another thread having a different color must be set in the apparatus and passed through the hole of an embroidery needle. This slows down the embroidery operation and makes it more costly.

Embroidery apparatus for industrial use and sewing machines capable of embroidering are known. However, it is necessary to change an upper thread corresponding to the designated color, so that when multi-color embroidery is performed, it is necessary to design the embroidery pattern taking into account the available colors, and then to embroider in such colors by exchanging the upper thread, as needed. Accordingly, a great deal of time and work is required to embroider in different colors using this technique. In addition, since many threads of various colors must be used, the colors are limited to the number of threads used, and therefore it is difficult to embroider in a large number, say five, colors. For example, when embroidering in colors varying continuously from dark green to yellow, it is necessary to provide threads of numerous colors and change them in accordance with the desired color, and therefore the ability of such embroidery techniques to express color variations is limited.

In recent years, textile printing using ink jet printing techniques has been put to practical use and fine printed material has been readily produced. However, it is difficult with such techniques to provide the three-dimensional effects possible with embroidery.

On the other hand, there is known a thread coloring technique in which warp threads are printed while being transferred from a bobbin to a weaving section to be woven with woof threads. Japanese Patent Publication Kokoku No. Sho 59-42093 discloses an example of such an ink jet thread printing technique. According to this document, an ink discharge nozzle having a diameter of 80 $\mu$m discharges ink onto a warp thread utilizing a pressure difference or energy of an electric field or the like to discharge the ink, and the dyed warp threads are then woven with woof threads. In that document, the diameter of the discharged ink droplet is larger than the diameter of the warp thread. As a result, due to overflow and blotting of the ink, the desired fine printing cannot be performed. Moreover, ink cannot be attached on the warp threads uniformly because the ink is applied only when the warp threads are in an upper position relative to the woof threads. In other words, the up-and-down movement of the warp threads significantly affects the precision with which the ink is applied thereto. In addition, the number of ink jet nozzles corresponds to the number of warp threads, making the apparatus large.

SUMMARY OF THE INVENTION

The present invention is designed to overcome the problems in the above-identified conventional structure.

In accordance with a feature of the present invention, an ink jet printing apparatus for printing an image using printing means to discharge ink onto a thread as the thread and the printing means move relative to each other comprises detecting means for detecting the speed of relative movement between the thread and the printing means, and control means for controlling an amount of ink discharged from the printing means and deposited on the thread per unit time in accordance with the detected speed of relative movement between the thread and the printing means.

In accordance with another feature of the present invention, an ink jet printing method for printing an image using printing means to discharge ink onto a thread as the thread and the printing means move relative to each other comprised the steps of detecting the speed of relative movement between thread and printing means and controlling an amount of ink discharged from the printing means and deposited on the thread per unit time in accordance with the detected speed of relative movement between the thread and the printing means.

In accordance with still another feature of the present invention, an embroidering apparatus comprises an ink jet printer for discharging ink onto a single-thread printing medium, control means for controlling the discharge of ink discharged from the ink jet printer onto the printing medium in accordance with pattern information, and embroidering means for embroidering the printing medium onto an embroidering medium to form a pattern corresponding to the pattern information.

In accordance with yet another feature of the present invention, an embroidering method comprises the steps of providing a printer for printing on a single-thread printing medium, controlling the discharge of ink from the printer onto the printing medium in accordance with pattern information, and embroidering the printing medium onto an embroidering medium to form a pattern corresponding to the pattern information.

In accordance with a yet further feature of the present invention, an ink jet printing and embroidering apparatus comprises transferring means for transferring a thread to be embroidered on a base medium, ink jet printing means for discharging ink onto the thread in accordance with pattern information as the thread is transferred relative to the printing means, sensing means for sensing an amount of the thread that has been transferred relative to the ink jet printing means, embroidery means for embroidering the printing medium onto the base medium to form a pattern corresponding to the pattern information, and detecting means for detecting an amount of thread non-usable for embroidering the pattern based on a distance the thread must travel from the ink jet printing means to the embroidery means.

In accordance with a still further feature of the present invention, an embroided product comprises a base medium having a pattern embroided thereon with a single-thread printing medium having different colors along the length thereof.

DETAILED DESCRIPTION OF THE PREFERRED EMBODIMENTS

In a first embodiment according to one aspect of the invention, a printing station is provided in the intermediate portion of a path for a thread being transferred toward an embroidering unit. In a dyeing station, dyeing of a thread is performed using ink jet heads, each of which discharges a different color. (As used herein, "embroidery" refers to forming patterns by stitching on a suitable base material.)

Typically, the ink jet heads discharge cyan (C), magenta (M), yellow (Y) and black (Bk) inks, respectively, although other colors of ink may be used, if desired. Each ink jet head preferably has plural nozzles for ink discharge, and ink is discharged from the nozzles in accordance with the speed of the thread.

That is, when the speed of the thread is low, ink is discharged from only one nozzle at a low frequency, and when the speed of the thread is high, ink is discharged from all nozzles at a high frequency, whereby a thread dyeing operation can be performed in full cooperation with the embroidery apparatus.

In addition, plural inks of different colors can be mixed on a thread in accordance with the color signal from a printing control unit, so that the thread can be printed in a substantially unlimited number of colors.

Figure 1:
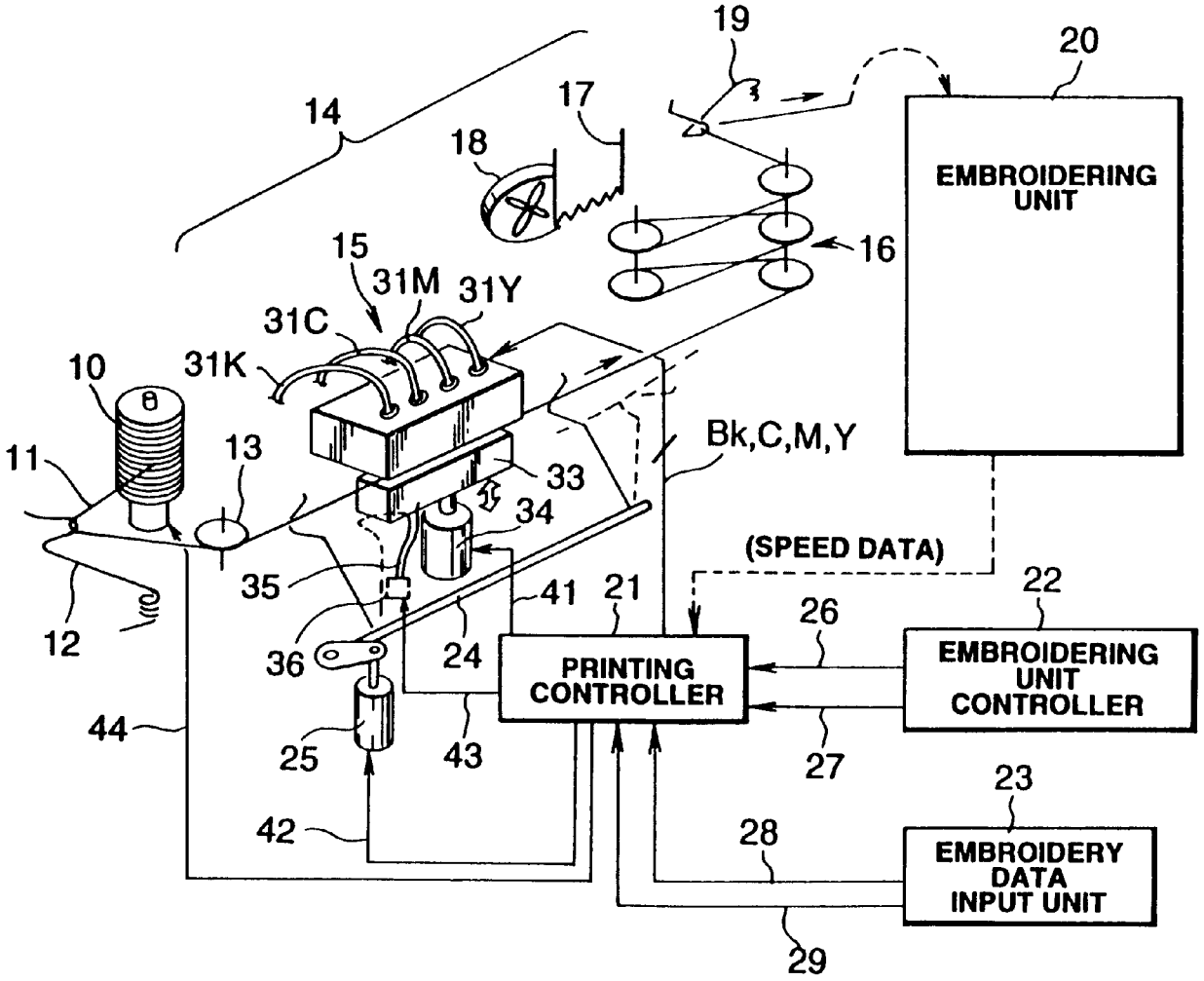
FIG. 1 is a schematic diagram of an embroidery apparatus with an ink jet printing apparatus according to a first aspect of the present invention.

FIG. 1 is a schematic diagram illustrating a construction of the embroidery apparatus having a printing unit according to one embodiment of the present invention.

The transfer direction of a thread 11 wound in a bobbin 10 is changed by a turn pulley 13 through a buffer lever 12. The thread is transferred to a printing station 14, where it is guided along a line of nozzles of an ink jet printing head 15 to be dyed by ink discharged from the nozzles of the ink jet head 15. The thread 11 coated by ink in this way is dried by a drier 16 located downstream of the ink jet head 15. The drier comprises a fan 18 that blows air heated by a heater 17 toward the thread 11. The dried thread is transferred through a buffer lever 19 to an embroidering unit 20 having conventional components for embroidering a pattern using the thread 11.

An embroidering unit controller 22 controls the operation of the embroidering unit 20 in response to an embroidery data input unit 23 that accepts embroidery data from a magnetic card (not shown) or data input means (not shown). The embroidery unit 20 thus embroiders a base material such as a cloth or the like in accordance with the embroidery data. The embroidery data include color data (tone, density, etc.) transmitted via a line 28 and thread data (indicating properties of the thread 11 such as size, kind of fiber, etc.) transmitted via a line 29 to the printing controller 21. Embroidery data is also transmitted to the embroidering unit controller 22 to operate the embroidering unit 20 in accordance with an embroidery pattern included in the embroidery data.

The embroidering unit controller 22 also calculates the moving speed of the thread 11 in connection with the embroidery operation of the embroidering unit 20 and transmits the speed via a line 26 to the printing controller 21. The moving speed of the thread 11 may be calculated on the basis of a signal from a speed sensor provided in the embroidering unit 20. The controller 22 transmits sequence data (concerning starting, operation and stopping of the embroidery unit 20) to the printing controller 21 via a line 27.

In this way, the printing controller 21 controls the discharge of ink from the ink jet head 15, capping of an ink discharge surface of the head 15 and an ink discharge recovery operation of the head 15 on the basis of data transmitted from the embroidering unit controller 22 and from the embroidery data input unit 23 via lines 26 to 29.

A lever 24 is provided for moving the thread 11 from a printing position next to the head 15 to a withdrawn position (shown respectively by a full line and a dotted line in FIG. 1) while the head 15 is being capped. The lever 24 is driven by an actuator 25.

A head cap 33 is arranged for capping an ink discharge surface of the head 15, where nozzles for discharging ink are located. A cap actuator 34 moves the head cap 33 to cap the ink discharge surface of the head 15 and to release the head cap 33 from the capping position. A suction tube 35 is connected to a suction pump 36 used in an ink discharge recovery operation that involves sucking ink from nozzles of the head 15 when the head cap 34 is in place in its capping position.

Figure 2:
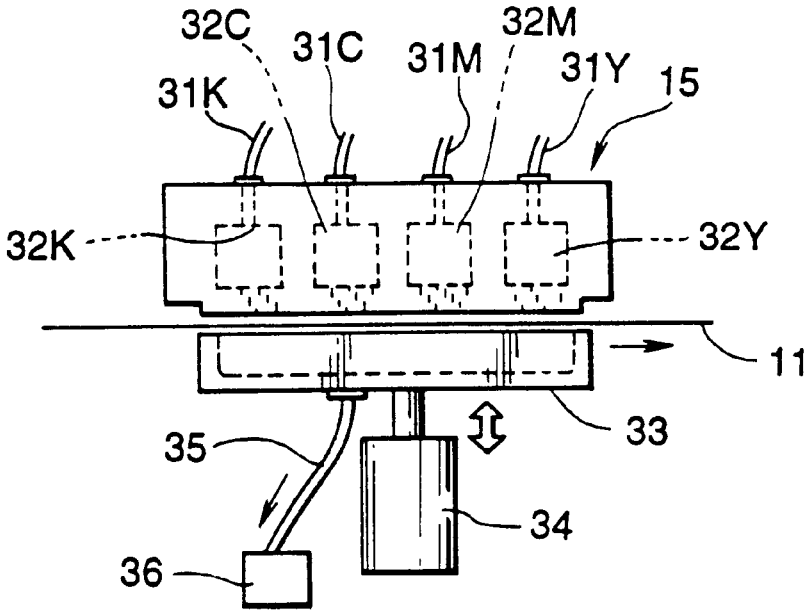
FIG. 2 is a schematic depiction of ink jet heads and associated structure used in the ink jet printing apparatus shown in FIG. 1.

FIG. 2 illustrates the ink jet head 15 and associated structure located at the printing station 14. The head 15 has groups of nozzles for discharging inks of black (Bk), cyan (C), magenta (M) and yellow (Y), respectively, and the groups of nozzles are disposed along the moving direction of the thread 11 in order to directly discharge inks onto the thread 11. From four to 32 nozzles can be provided for each color of ink. Inks are discharged from the nozzles onto the thread 11 in accordance with drive signals Bk, C, M and Y from the printing controller 21, based on the number of nozzles to be used in each group and the ink discharge frequency.

Each color of ink is supplied from ink tanks to ink chambers 32Y (yellow), 32C (cyan), 32M (magenta) and 32K (black), through respective ink supply tubes 31Y, 31M, 31C and 31K. The ink chambers are in flow communication with the nozzles for discharging ink and fine ink droplets are discharged onto the thread 11 by sending pulses of electric current (based on the drive signals Bk, C, M and Y) to minute heaters provided in these nozzles, in accordance with known techniques.

When the printing operation pauses, the thread 11 can be moved from the printing position, that is, the position between the nozzle surface of the head 15 and the cap 33, by movement of the lever 24 which is driven by the actuator 25. Then, the cap 33 can cap the nozzle surface of the head by driving the cap actuator 34. In this operation, as described in the foregoing, the ink discharge recovery operation may be carried out as occasion demands.

Figure 3:
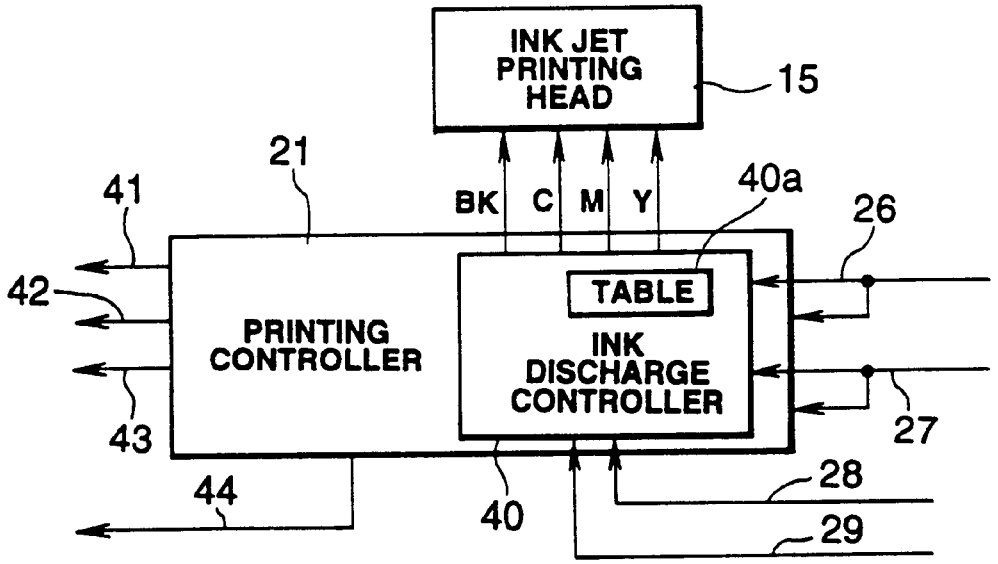
FIG. 3 illustrates the printing controller depicted in block form in FIG. 1.

FIG. 3 schematically illustrates the construction of the printing controller 21 according to this embodiment. The printing controller 21 has therein an ink discharge controller 40, which determines a proper discharge ratio between the various inks on the basis of hue data included in the color data sent via the line 28. In addition, the discharge controller determines ink discharge amount (dot/second) on the basis of density data included in the color data, the thread data (for example, the size and kind of thread) sent via the line 29 and thread speed data sent via the line 26. Since the speed of the thread 11 dynamically varies with the operation of the embroidering unit 20, the amount of ink discharged from each head of the printing head 15 is controlled in real time in accordance with the speed of the thread 11. The ink discharge controller thus outputs the drive signals Bk, C, M, Y corresponding to each color to the head 15.

The printing controller 21 also outputs a control signal 41 for controlling the cap actuator 34, a control signal 42 for controlling the actuator 25 to move the thread 11 from the printing position, a drive signal 43 for driving the suction pump 36 used in an ink jet recovery operation, and a control signal 44 in accordance with the acceleration and deceleration of the thread 11 (based on the thread speed data on line 26) to brake the bobbin 10.

Figure 4:
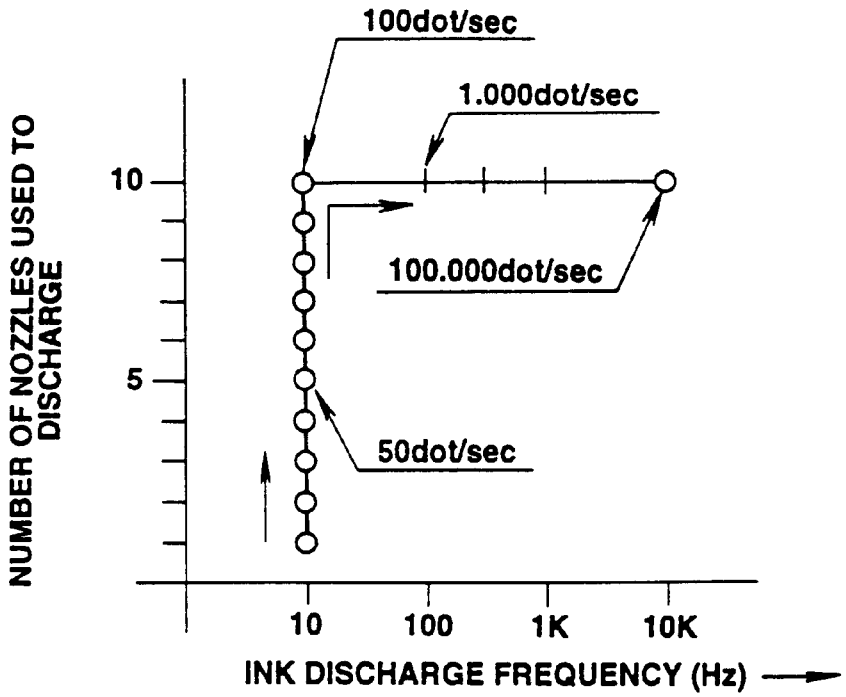
FIG. 4 is a graph illustrating the connection between ink discharge frequency and the number of ink discharge nozzles used to color an embroidery thread.
Figure 5:
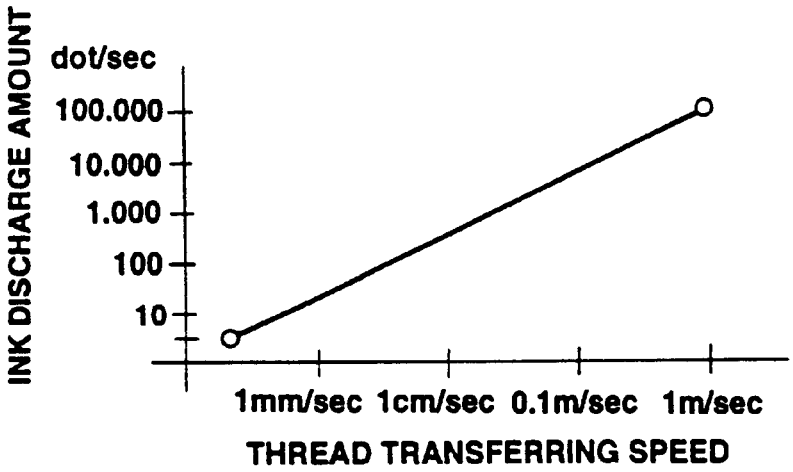
FIG. 5 is a graph illustrating the connection between the transfer speed of the thread and the amount of ink discharged by the printing head.

FIG. 4 is a graph for explaining a relation between the number of nozzles to be used for coloring the thread and the ink discharge frequency. FIG. 5 is a graph for explaining the amount of ink discharged according to the moving speed of the thread 11.

In FIG. 4, when the moving speed of the thread is low, ink is discharged in the amount of 10 dots/second (one nozzle operated at 10 Hz). With a constant ink discharge frequency, ink can be discharged in the amount of 100 dots/second by increasing the number of nozzles to be used. In addition, by increasing the ink discharge frequency, the ink discharge rate can be increased up to 100,000 dots/second at an ink discharge frequency of 10 KHz. That is, the number of ink droplets discharged onto the thread per unit time varies in accordance with the thread transferring speed past the printing position.

Therefore, according to the present embodiment, a proper amount of ink can be discharged for thread speeds ranging from a few mm/second to 1 m/second.

Figure 6:
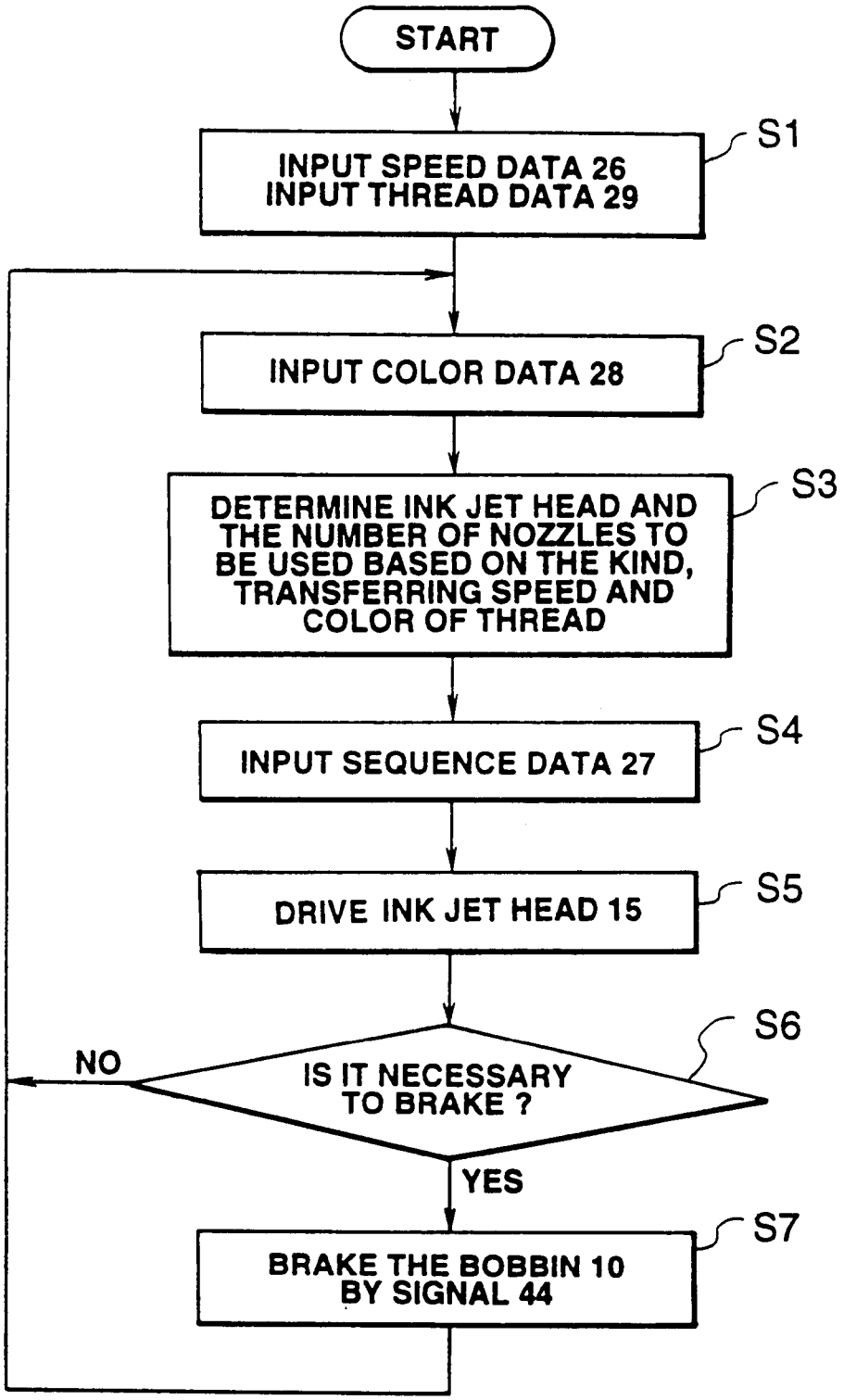
FIG. 6 is a flow chart explaining the operation of the printing controller shown in FIG. 3.

FIG. 6 is a flow chart for explaining the operation of the printing controller 21. In step S1, the speed data 26 is input from the embroidering unit controller 22 and the thread data 29 is input from the embroidery data input unit 23. In step S2, color data 28 corresponding to the thread 11 to be used is input from the embroidery data input unit 23. In step S3, data for the ink jet head, such as the number of nozzles and discharge frequency, are determined on the basis of the size, kind and moving speed of the thread and the color to be deposited thereon. The number of nozzles to be used and the ink discharge frequency may be determined by referring to a table 40*a* in the ink discharge controller 40. This table stores the number of nozzles and the ink discharge frequency to be used for different sizes, kinds and moving speeds of the thread 11.

Next, in step S4, the sequence data 27 is input from the embroidering unit controller 22, and in step S5 the printing head 15 is driven by the drive signals Bk, C, M and Y in accordance with the ink discharge frequency and using the nozzles determined in step S3. In the printing process, when it is necessary to brake the bobbin 10, as determined in step S6, control is advanced to step S7 and the bobbin 10 is in accordance with the control signal 44.

If an ink discharge recovery operation is to be performed, the thread 11 is retracted from the printing position by the lever 24, moved by the actuator 25 on the basis of the signal 42. Then, the head 15 is capped by the cap 33 driven by the actuator 34 on the basis of the signal 41. After that, an ink discharge recovery operation is performed by sucking ink from the head 15 using the suction pump 36, operated on the basis of the signal 43.

Figure 7:
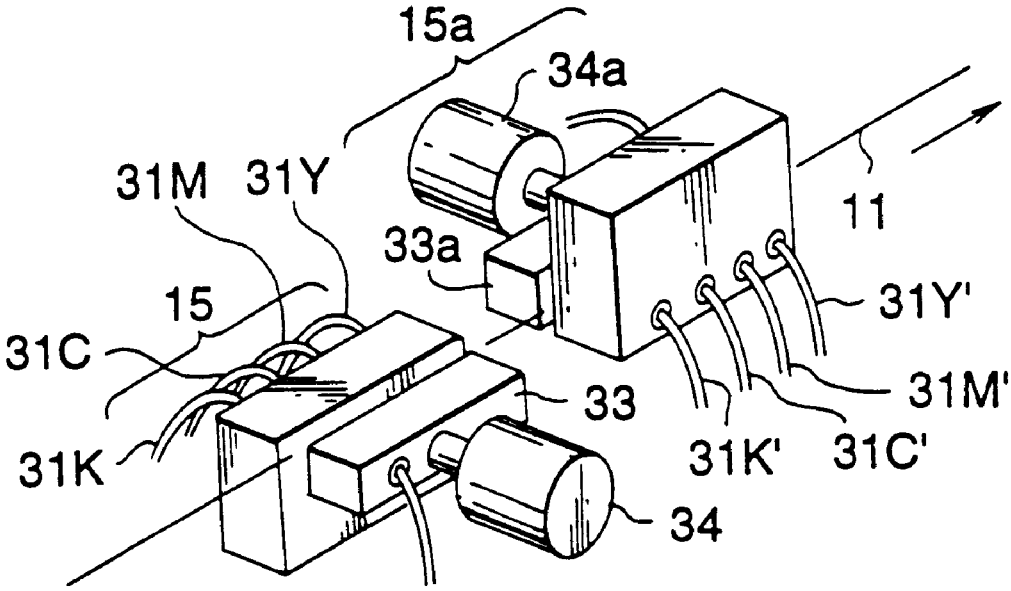
FIG. 7 is a perspective view showing another embodiment of a printing station for a printing apparatus according to the present invention.

FIG. 7 shows a construction of a printing station according to another embodiment of this aspect of the present invention, wherein elements common to the first embodiment are shown by the same numbers. In this embodiment, printing heads 15, 15*a* are provided along the movement direction of the thread 11. According to this construction, ink droplets are discharged onto the thread 11 from the printing head 15 on the left side along the movement direction of the thread 11, and on the other hand, ink droplets are discharged onto the thread 11 from the printing head 15*a* on the right side along the movement direction of the thread 11. Ink is thus discharged from both sides of the thread 11 in order to facilitate proper coloring of the thread 11 if it is moving at a very high speed. A cap 33*a* is disposed for capping the printing head 15*a*, and an actuator 34*a* is provided for driving the cap 33*a*.

As described in the foregoing, a suitable amount of ink can be discharged onto a thread by controlling the amount of ink to be discharged in accordance with the relative speed between the thread and one or more printing heads.

The color of the thread is determined by design data, and multi-color embroidery can be performed more easily using the thus-printed thread.

According to this aspect of the invention, even if the speed of the moving thread varies from very slow to very fast, properly printed thread can be supplied to the embroidering unit, whereby a high quality embroidered product, free from splashes or blots, can be obtained. In addition, the embroidery apparatus of the present invention can embroider in numerous colors using only one thread.

Figure 8:
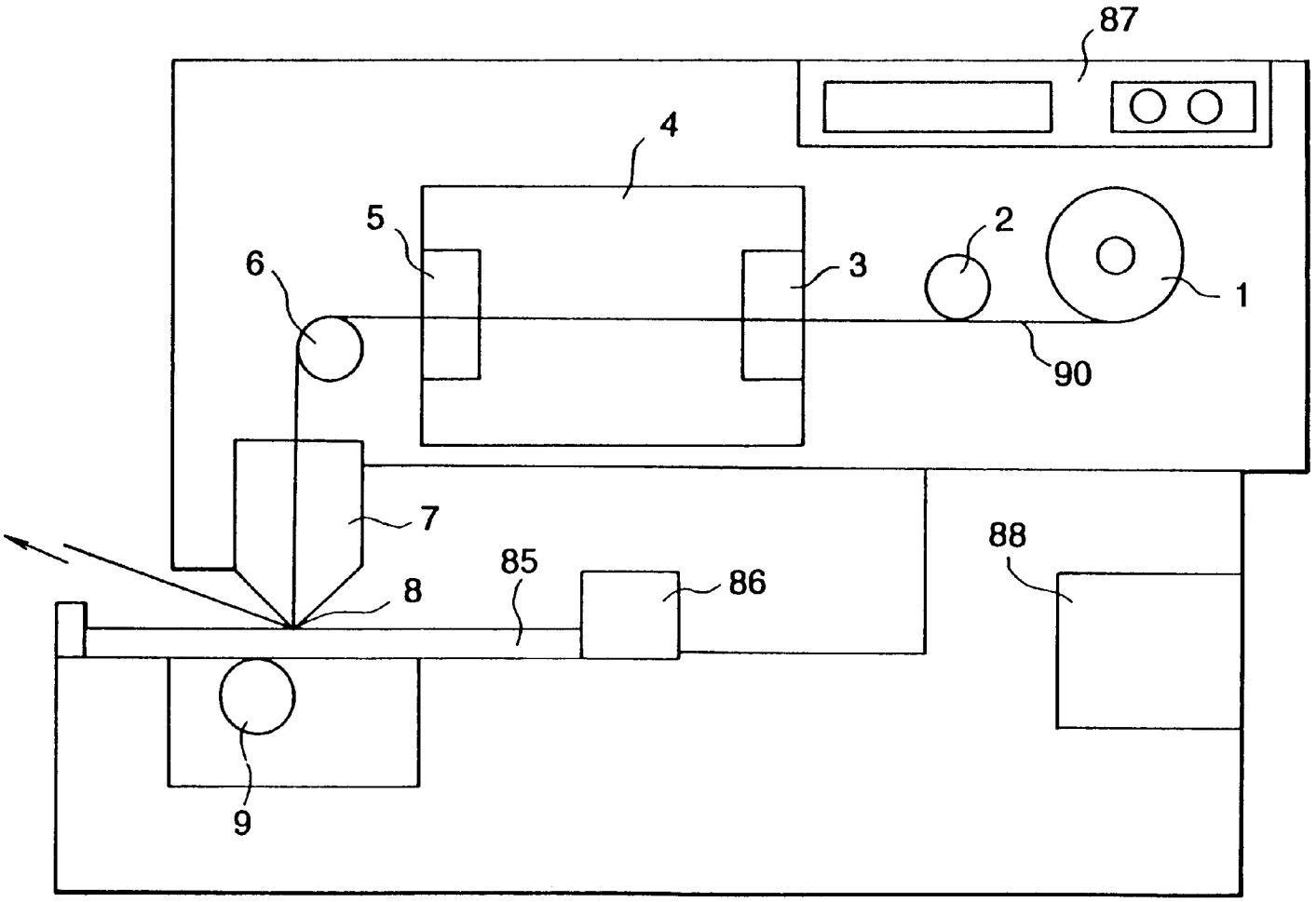
FIG. 8 is a schematic diagram of an embroidery apparatus with an ink jet printing unit in accordance with a second aspect of the invention.

FIG. 8 shows the main construction of an embroidery or sewing apparatus using an ink jet printing unit for printing an upper thread according to a second aspect of the invention. The printing of the upper thread and the embroidery processes according to this depicted embodiment of the invention are described hereinafter.

An upper thread 90 is wound in a bobbin 1 rotatably mounted in a bobbin receiver (not shown). The upper thread 90 firstly moves around a spool 2 having a rotary encoder for detecting the amount of the upper thread that has been fed from the bobbin, which enables determination of a position on the thread 90. The thread 90 then goes through a pre-treatment unit 3 in order to uniformly coat it with a pre-treatment solution such as a blot controlling agent prior to printing. The pre-treated thread 90 is then transferred to the ink jet printing unit 4. At the ink jet printing unit 4, a predetermined number of ink droplets of each color are discharged onto the thread 90 in accordance with printing data generated on the basis of embroidery pattern information provided by pattern data input means 88 and thread transfer amount information provided by the rotary encoder associated with the spool 2.

The ink applied on the thread 90 is heated and steam treated at an additional processing unit 5, which fixes and brightens the color on the thread 90, and the thread 90 is then transferred to a tip 8 of a needle 7 through thread condition adjusting means 6. The thread 90 is then embroidered on a base cloth 85 by the needle 7, which is driven in accordance with the embroidery pattern information. A lower thread is drawn from a bobbin 9 and a base cloth moving unit 86 moves the base cloth 85 onto which the pattern is embroidered. An operation panel 87 enables an operator to control the apparatus. The embroidery or sewing apparatus used in this aspect of the invention also has conventional components for operating with a single upper thread and a lower thread.

Since the embroidery pattern information can be similarly applied as in the prior embroidering apparatus, a detailed explanation of the embroidering process is omitted. That is, the embroidering apparatus according to the second aspect of the invention also embroiders on a base cloth while the ink is discharged onto a thread in accordance with the embroidery patten information. However, this aspect of the invention accounts for the fact that discharging ink at a location remote from where it is applied to the base cloth makes it necessary to ensure that the printed upper thread is embroidered into the base cloth in accordance with the pattern information. In other words, since there is a length of thread between the tip of the needle and the ink jet printing unit, the embroidery operation must take that length into account.

Therefore, according to this embodiment, when starting the embroidering operation, a predetermined point is chosen on the path of the upper thread between the bobbin 1 and the pre-treatment unit 3. The length of thread between that predetermined point and the needle point is not used in the embroidery operation.

The rotary encoder associated with the spool 2 is used to properly time the initiation of printing on the thread 90 at the predetermined point as the thread moves through the printing unit 4 to the needle 7. Before the printed portion of the thread 90 reaches the tip 8 of the needle 7, the non-usable portion is embroidered on the base cloth 85 in a temporary or provisional pattern.

The position to begin temporarily embroidering on the base cloth is determined and the provisional embroidery pattern is made in one embodiment such that the provisional embroidery pattern on the base cloth does not overlap the actual desired embroidery pattern. When the properly printed portion of the thread reaches the needle tip, embroidery of the actual pattern is begun.

As shown in FIG. 9, the provisional embroidery pattern beginning and ending positions and the actual embroidery pattern beginning position are the same.

Figure 9A:
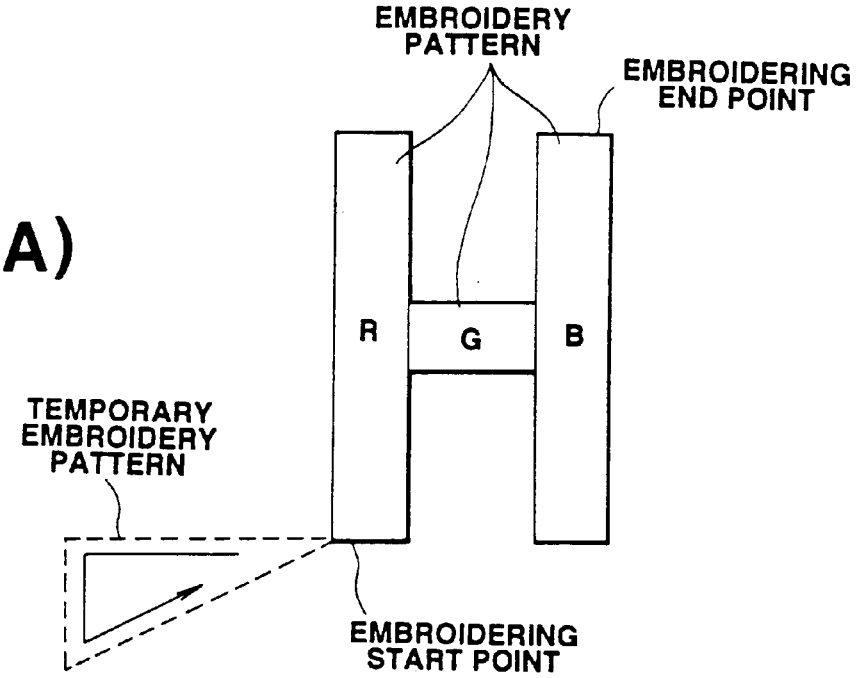
FIGS. 9(A) and 9(B) illustrate two temporary embroidery patterns that account for unusable thread produced in the apparatus shown in FIG. 8.

In FIG. 9(A), the temporary or provisional embroidery pattern is determined such that it does not overlap the actual embroidery pattern, which in FIG. 9 is an "H" of red, green and blue. As noted above, the length of the thread to be temporarily embroidered and the length of thread between the predetermined point and the needle tip is same. One temporary embroidering operation may be performed by estimating the length of thread necessary to produce the desired temporary embroidery pattern based on the most suitable tensile force of the upper thread in view of the material and the weight of the base cloth and the material and the size of the thread. If the beginning and ending points of the temporary pattern do not coincide, another non-usable thread portion can be determined and another temporary pattern may be embroidered on the basis of correction data generated from the first temporary embroidery pattern.

This correction also can be carried out during the actual embroidery operation, and some delay of the correction on account of the thread portion between the ink jet printing unit and the needle tip can be ignored because the non-usable portion of the thread is usually not readily visible in the desired embroidery pattern on the base cloth.

Alternatively, the user may correct for different embroidery conditions by selecting and setting suitable correction data from plural correction data that has been previously prepared and stored in the apparatus.

In any event, the temporary embroidery pattern shown in FIG. 9(A) can be removed from the base cloth when the actual embroidery is complete.

Figure 9B:
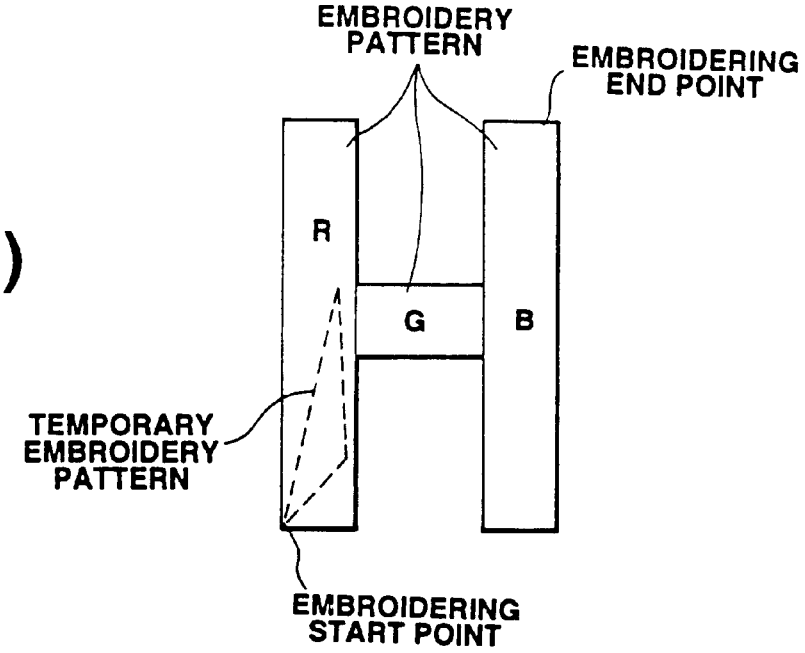

FIG. 9(B) shows a modified temporary embroidery pattern. As shown in FIG. 9(B), if the temporary embroidery pattern is small enough, it can be placed wholly within a portion of the actual embroidery pattern, since it generally will not show through the actual pattern. As a result, the removal of the upper thread used in the temporary embroidery pattern is not necessary.

As a further modified embodiment, after the thread is in place in the needle, the proper thread distance can be printed while the thread is pulled from the needle. Then, the initial printed portion of the upper thread is located at the tip of the needle and the embroidering operation can be initiated. Since there may be time requirements in solution coating processes for pretreating the thread, in the ink jet printing itself and in post-printing treating processes, the upper thread must be manually drawn out at a predetermined speed. Such speed can be maintained in a predetermined range by providing a braking system which operates in accordance with detected thread transferring amount information.

If the embroidery pattern is not continuous, a continuous embroidering operation can still be performed without resetting the upper thread by using the above-described temporary embroidery technique to skip printing on thread portions between parts of the pattern. In that case, the temporarily embroidered upper thread between the parts of the pattern can be easily removed by using any well-known automatic thread cutting mechanism.

According to this embodiment, the pre-treatment unit for the upper thread is provided to make conventional thread more suitable for this invention. However, by using an already treated thread, the pre-treatment unit 3 can be omitted. In that same connection, the pretreatment process has as its purpose mainly the control of the spreading of ink. If a pre-treatment solution is used that is deposited on the thread, it should be removed, for example, by passing the thread through squeezing rollers.

Figure 10:
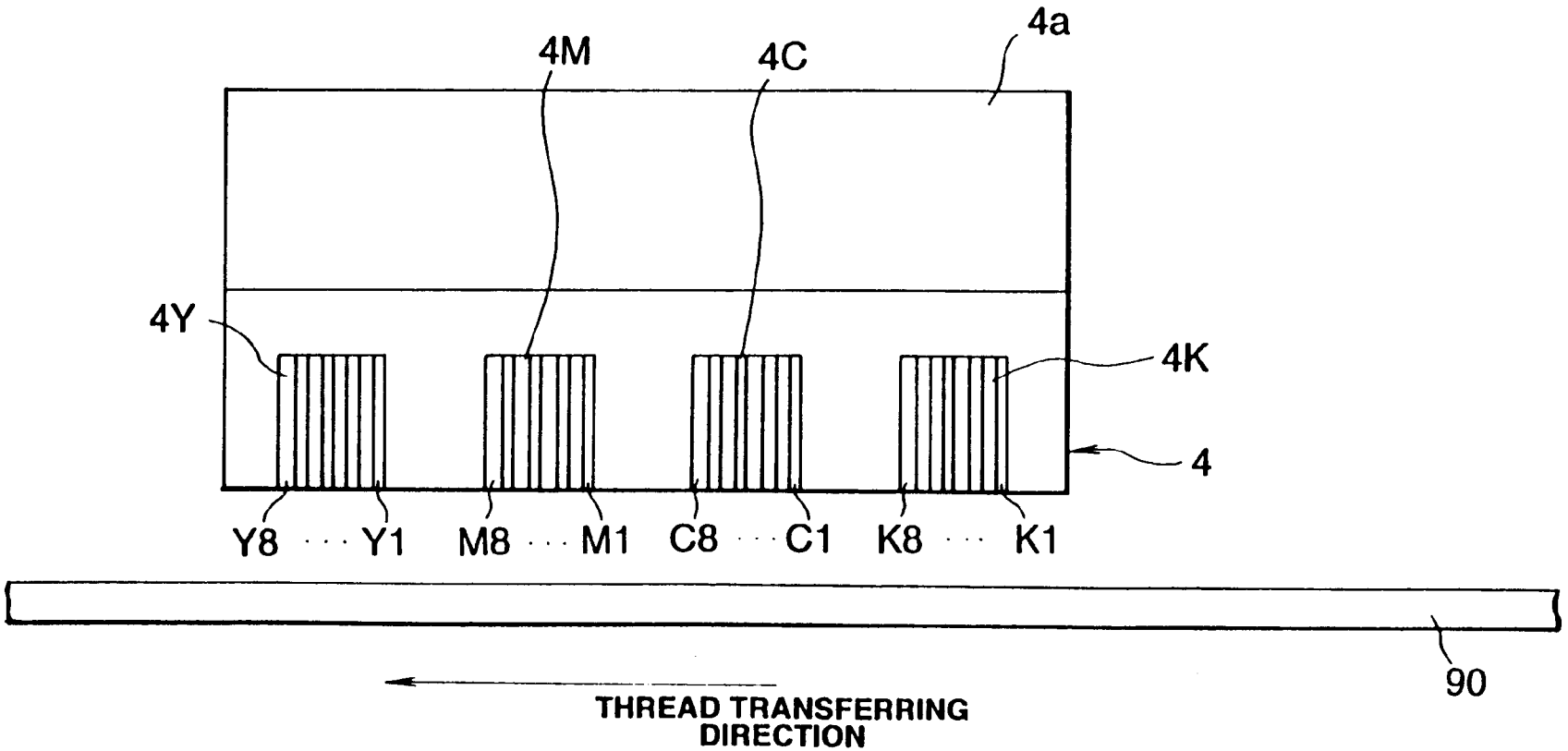
FIG. 10 illustrates printing on a thread by ink jet heads of the printing unit shown in FIG. 8.

FIG. 10 shows a construction of the ink jet printing unit 4. In this embodiment, four ink jet heads 4K, 4C, 4M and 4Y, each have eight nozzles K1 to K8, C1 to C8, M1 to M8, and Y1 to Y8, for discharging, respectively, black, cyan, magenta and yellow inks. The nozzles are provided along the direction of the upper thread movement. An ink tank 4*a* holds the different color inks for supply to the respective heads.

A diameter of an ink droplet discharged from each nozzle is set to be smaller than the diameter of the upper thread. For example, in this embodiment, the diameter of the ink droplet is about 40 $\mu$m (expressed as an equivalent diameter of a sphere having the same volume as that of the ink droplet). It is preferable to have the diameter of the ink droplet smaller than that of the upper thread. Since the ink spreads to cover about twice the diameter of the droplet when the ink is applied to the thread, it is more preferable to use a suitable control circuit to set the diameter of the ink droplet to be not more than half that of the thread.

In this embodiment, the diameter of the upper thread is about 120 $\mu$m when it is transferred under the proper tension and plural different colors of ink droplets can be applied on the same portion of the upper thread. For example, four ink droplets of cyan and four ink droplets of yellow may be applied to a particular location on the upper thread if that location is to be printed in green. In that case, ink is discharged from the nozzles C1, C3, C5 and C7, and Y1, Y3, Y5 and Y7 as that location on the upper thread is opposed to each such nozzle. Since the impact area of the ink will vary with the distance between the ink discharge nozzle and the upper thread, the speed of the thread and the speed of the discharged ink droplet, the ink is actually discharged at a timing corrected for those factors.

The reason those particular nozzles are chosen is because it provides the maximum time between the depositing of consecutive droplets. That is, instead of using adjacent nozzles (say C1 to C4), every other nozzle (here odd-numbered nozzles C1, C3, C5 and C7) is used. That gives each droplet the maximum time to permeate into the thread before the next droplet is deposited. That ensures the maximum spread of the droplets, since it inhibits permeation deeper into the thread of a subsequently deposited droplet. To ensure that the maximum number of nozzles are used, even numbered nozzles can be used to print on some locations and odd-numbered nozzles to print on other locations. The switching between even- and odd-numbered nozzles can be done on a random basis under the control of a random number generator.

The ink jet head used in this embodiment is a unified head having 32 total nozzles, in which the space between adjoining nozzles of the same color is about 70 $\mu$m, and the space between adjoining nozzles of different colors is 56 $\mu$m. With a print density of 360 dpi and a maximum ink discharge frequency is 6.12 kHz, the maximum thread transferring speed is about 432 mm/sec. Therefore, such a printing unit can be used when the sewing speed is as high as 1800 stitches/minute and the pitch of each stitch is 5 mm; as a result, the embroidering speed will typically not limited by the printing speed of the ink jet printing unit. There are various methods which are applicable to this invention in order to increase the speed of ink jet dyeing (for example, for maximum thread transfer speed the number of nozzles used for each color is doubled).

FIG. 11 is a perspective view showing parts of an ink jet head that can be used in the printing unit 4 to discharge inks of four different densities. One such head can be used for each color ink.

Figure 11B:
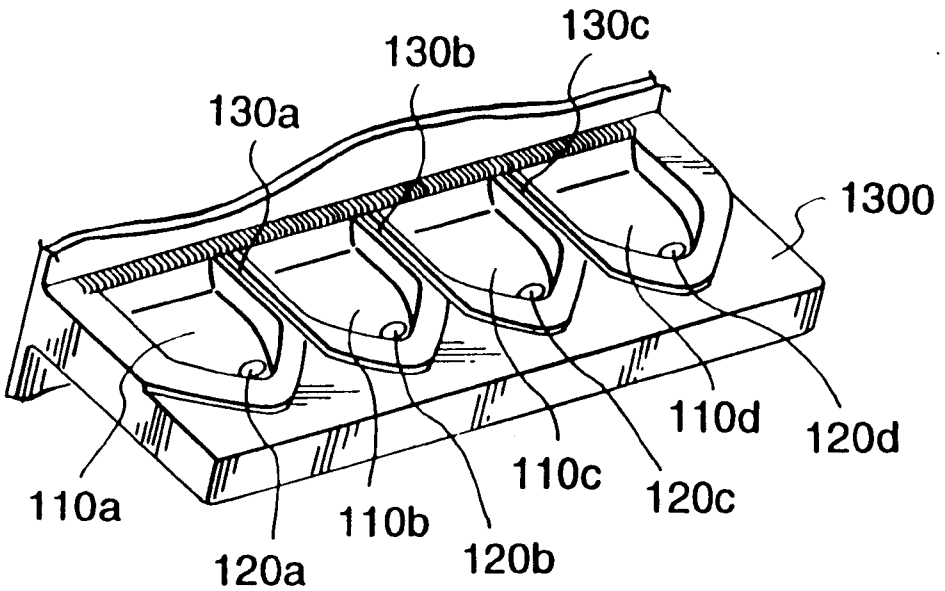
FIGS. 11(A) and 11(B) are perspective views showing parts of an ink jet head which can discharge ink of different densities.
Figure 11A:
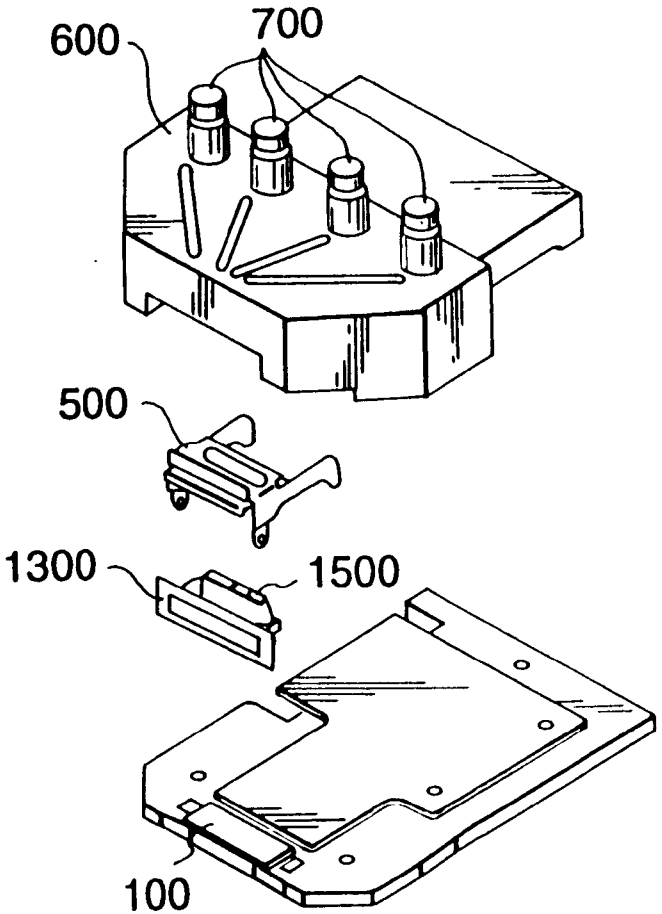

FIG. 11(A) is a magnified view of such an ink jet head. A cover 600 has four ink-intake filters 700 which respectively correspond to each partitioned ink chamber described below. The cover 600 presses a top board 1500, which has nozzles, ink discharge ports and an orifice plate 1300 forming the ink chambers, toward a heater board 100 through a spring member 500.

FIG. 11(B) shows the orifice plate 1300 even more greatly enlarged. Ink chambers 110*a*, 110*b*, 110*c* and 110*d* are partitioned by walls 130*a*, 130*b* and 130*c*, respectively, and inks having different densities are drawn into these ink chambers through ink receiving portions 120*a*, 120*b*, 120*c* and 120*d*, each of which receives ink through a filter 700.

This structure enables color printing with very slight gradations in color, thus enhancing the number of colors available for embroidering.

Figure 12:
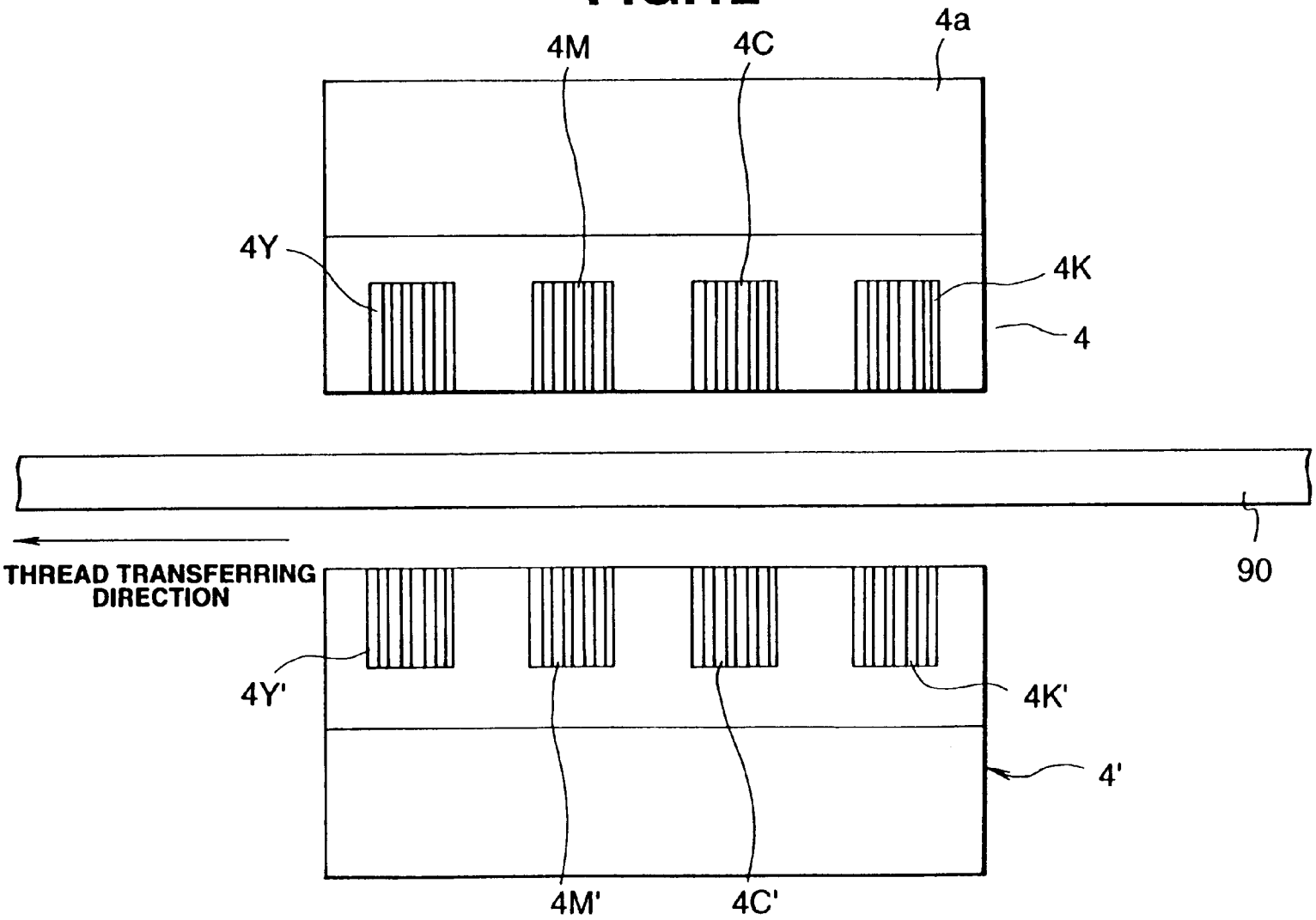
FIG. 12 illustrates printing on two sides of a thread using two ink jet printing units.

FIG. 12 shows a modified example of the ink jet printing unit, in which the diameter of the upper thread is much larger than that of an ink droplet. In FIG. 12, a second ink jet head 4' is disposed facing the head 4, and these heads discharge inks onto the thread 90 from two sides.

Figure 13:
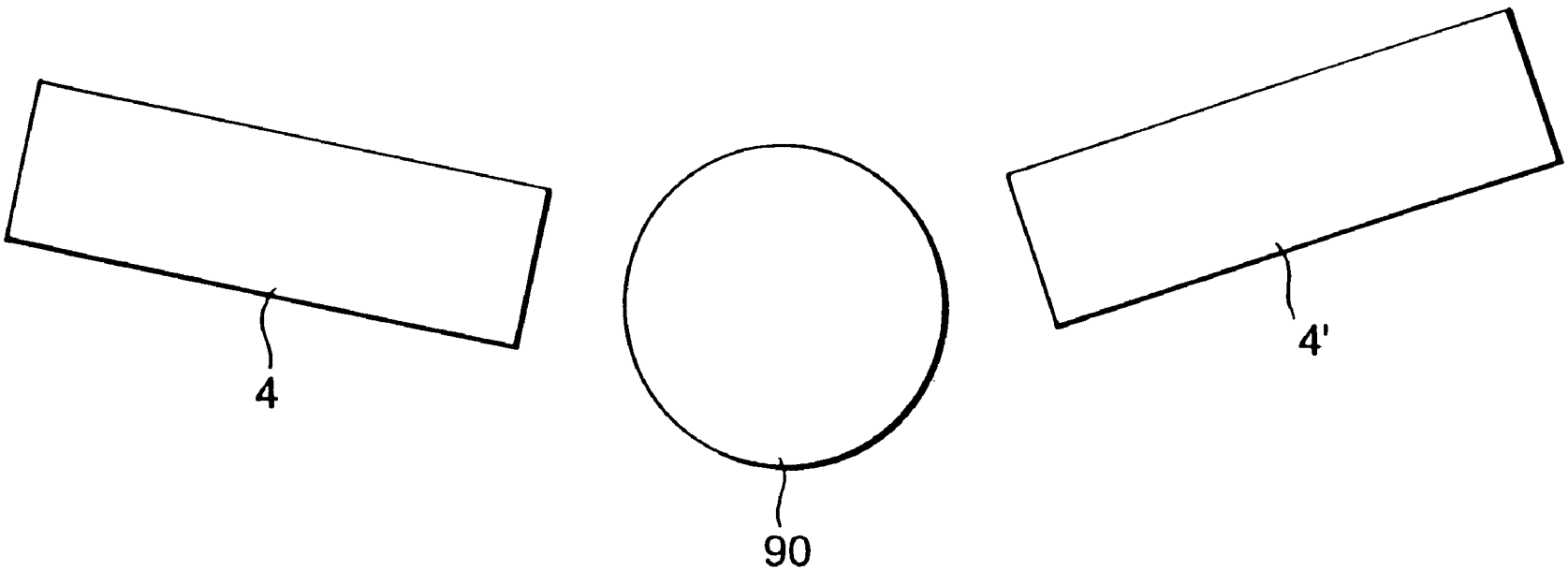
FIG. 13 illustrates the orientation of the ink jet printing units shown in FIG. 12.

FIG. 13 is a view from the side of a section of the upper thread 90, showing the two ink jet heads 4 and 4' positioned such that they are not diametrically facing each other. This angular positioning inhibits ink mist originated concurrently with the ink discharge from each ink jet head from settling on the face of the opposite ink jet head.

Figure 14:
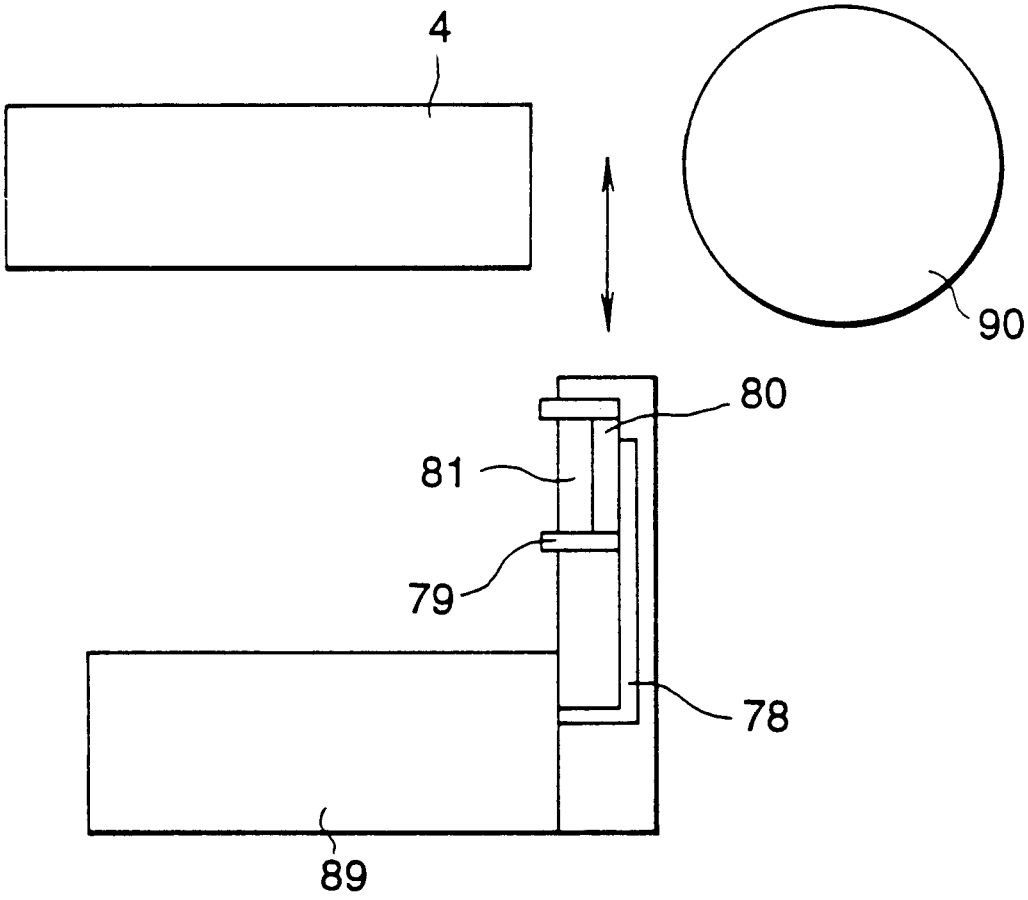
FIG. 14 illustrates a maintenance unit for an ink jet head in the printing unit shown in FIG. 8.

FIG. 14 illustrates a maintenance unit for the ink jet head 4. A cap 79 (similar to the cap 33 in FIG. 1) is used to protect the head 4 while it is not being used and in sucking ink from the head in an ink discharge recovery operation. A wiping member 81 can wipe the head to remove ink mist and waste thread particles on the head surface, and an absorbing member 80 receives ink sucked from the ink jet head in an ink discharge recovery operation. A suction pump 89 (see pump 36 in FIG. 1) sucks ink from the nozzles through the absorbing member 80 via an ink path 78.

According to this embodiment, the upper thread printed by the ink jet printing unit is heat treated by the unit 5 as an additional process. However, if the pretreatment solution and the ink have suitable properties, it is possible to omit this additional process. For example, the thread may be heat treated by ironing after the embroidering operation is performed.

Figure 15:
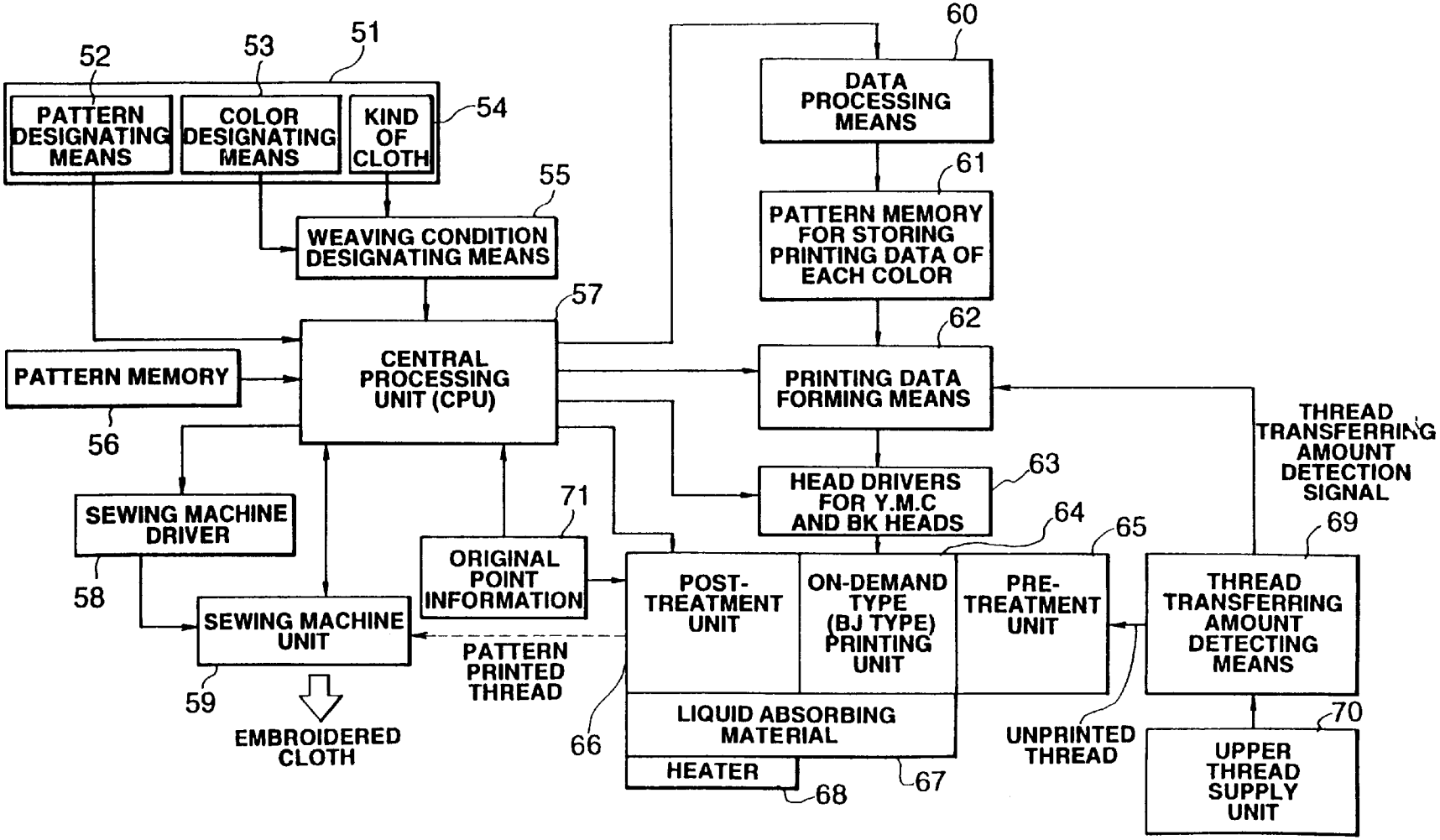
FIG. 15 is a schematic diagram of the control system for an embroidery apparatus according to the second aspect of the invention.

FIG. 15 is a block diagram schematically illustrating an embodiment of the control of an ink jet embroidery apparatus according to the present invention. In FIG. 15, printing data, comprised of data on printing position on the upper thread and printing conditions, such as ink color and the number of ink droplets, are generated on the basis of printing pattern information from embroidery pattern input means. The printing data are corrected on the basis of a moving amount of the thread, which is determined in accordance with variable embroidering conditions, and the ink jet embroidering operation is performed on the basis of the printing data. The embroidery pattern information may be selected from patterns previously memorized in a memory such as a ROM in the embroidery apparatus.

An operation panel 51 is used by an operator of the embroidering apparatus. The operation panel 51 has pattern designation means 52 for designating an embroidery pattern, which is stored in an embroidery pattern memory 56 such as a floppy disc or a RAM in the embroidery apparatus, by inputting a code representing a particular stored pattern, by designing a pattern from various patterns indicated on a display.

The operation panel also has cloth designating means 54 for indicating properties of the cloth to be embroidered, such as its thickness, material or the like, and color designating means 53 for designating the desired colors in particular portions of or in the entire embroidery pattern.

Weaving condition correction means 55 provides information on the amount of thread needed to provide the selected pattern on the basis of information from the cloth designating means 54 and the color designating means 53. This corrected information is sent to printing data forming means 62 through a CPU 57. For example, the amount of thread needed in each color will depend on the type of the base cloth, that is, how tightly woven it is, and its thickness.

Data processing means 60 converts the embroidery pattern information, including the color information, to printing data in accordance with the colors of ink discharged by the ink jet printing unit and the pattern data. In this embodiment, the original pattern color data is converted to color data for yellow, magenta, cyan and black inks and the color data converted by the data processing means 60 is temporarily stored in a printing pattern memory 61 for memorizing the respective pattern data for each color.

A thread transferring amount detecting means 69 accurately detects the amount of thread supplied from an upper thread supply unit 70 and provides its output to the printing data forming means 62. The printing data forming means generates final data for printing in each color on the basis of the information from the printing pattern memory 61, the correction data from the weave condition correction means 55 and the information on the length of thread from the thread transferring amount detecting means 69.

Head drivers 63 for yellow, magenta, cyan and black print heads, receive the printing data and drive an on-demand, bubble jet type ink jet printing unit 64 with a head for each such color (see head 4 in FIG. 8, for example).

A pre-treatment unit 65 in front of the ink jet printing unit 64 carries out known pre-treatment of an unprinted thread in order to improve its capacity for printing. If the undyed thread has already been pretreated, the pre-treatment unit 65 can be omitted.

A post-treatment unit 66 fixes the ink on the thread. In this embodiment, a liquid absorbing material 67 for absorbing water produced from the printing unit 64 and ink discharged during an ink discharge recovery operation are heated by a heater 68, and the generated vapor can be used in the post-treatment process. This retains the liquid absorbing capacity of the liquid absorbing material while the water absorbed thereby is efficiently used.

Since only the thread for embroidery is printed and the base cloth is not printed, the ink jet printing unit is very small compared with a printing unit used to print directly on the cloth. Therefore, the dyeing apparatus of this invention can be kept compact.

Subsequently, the upper thread passed through the post-treatment unit 66 is transferred to a sewing unit 59, driven by a driver 58 in accordance with the designated color and information stored in the pattern memory, whereby the embroidered cloth is manufactured.

An original point detector 71 determines the print beginning point on the thread. As discussed above, this point is used to determine the timing when temporary embroidering is changed to actual embroidering.

As described hereinbefore, embroidery is performed using an upper thread which is printed by the ink jet method in accordance with the embroidery pattern, whereby embroidery in an extremely large number of colors can be performed without exchanging threads.

Figure 16:
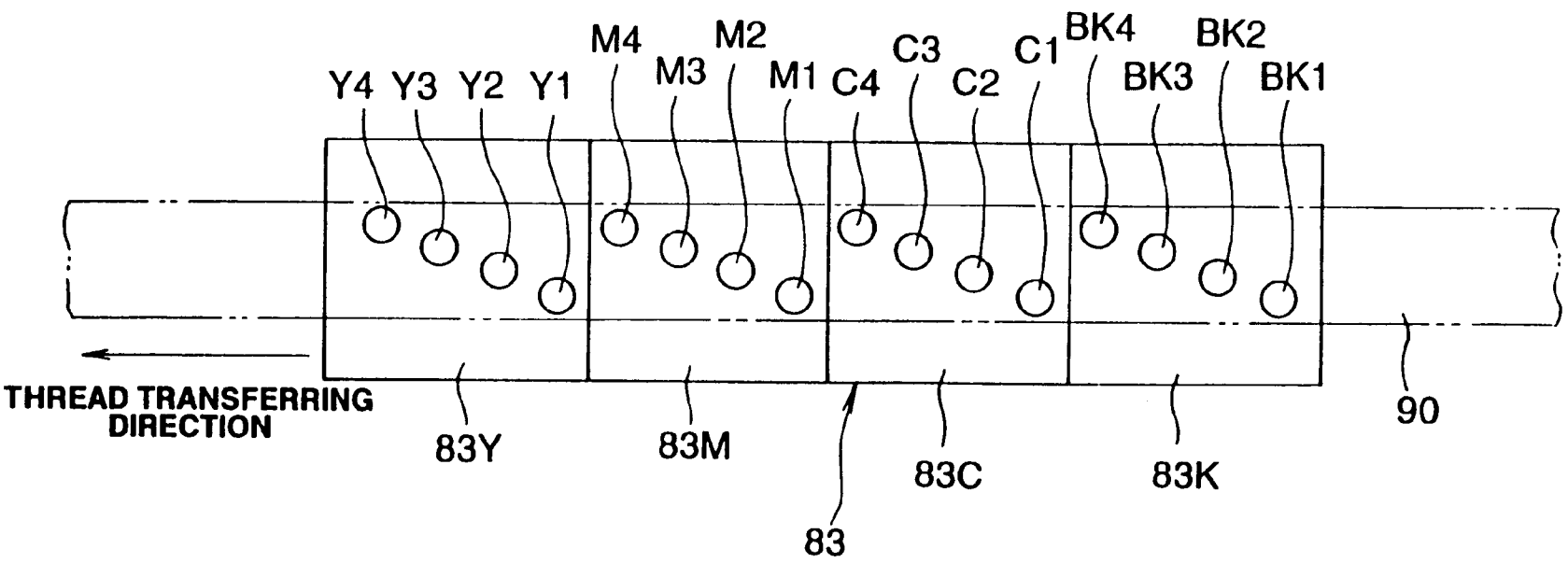
FIG. 16 illustrates printing on a thread by modified ink jet heads according to the present invention.

FIG. 16 is a schematic view of an ink jet printing unit used in the ink jet embroidering apparatus according to another embodiment.

In this embodiment, the ink jet printing unit 83 comprises ink jet heads 83K, 83C, 83M and 83Y. It is constructed such that the number of ink jet nozzles used to color the thread can be changed in accordance with the size of the thread as designated at the operation panel, in order to optimize the appearance of the embroidery in accordance with the size of the thread. The size of the thread can also be detected by size detecting means such as an optical sensor or the like provided along the thread path.

In FIG. 16, assuming that a thread guiding member is provided at the lower edge of the thread, the upper edge of the thread (as seen in the figure) will be displaced upward for thicker thread. Therefore, additional nozzles are added for ink discharge as the diameter of the thread increases.

FIG. 16 depicts a large-diameter thread that will be printed using all four nozzles for a particular color. That is, a smaller thread might only extend to the third nozzle of each head, for example, and thus the fourth nozzle would not be used. For example, if a large-diameter thread is to be colored black, ink would be discharged from nozzles Bk1 to Bk4. If the smallest size thread is to be colored, ink would be discharged only from nozzle Bk1.

Figure 17:
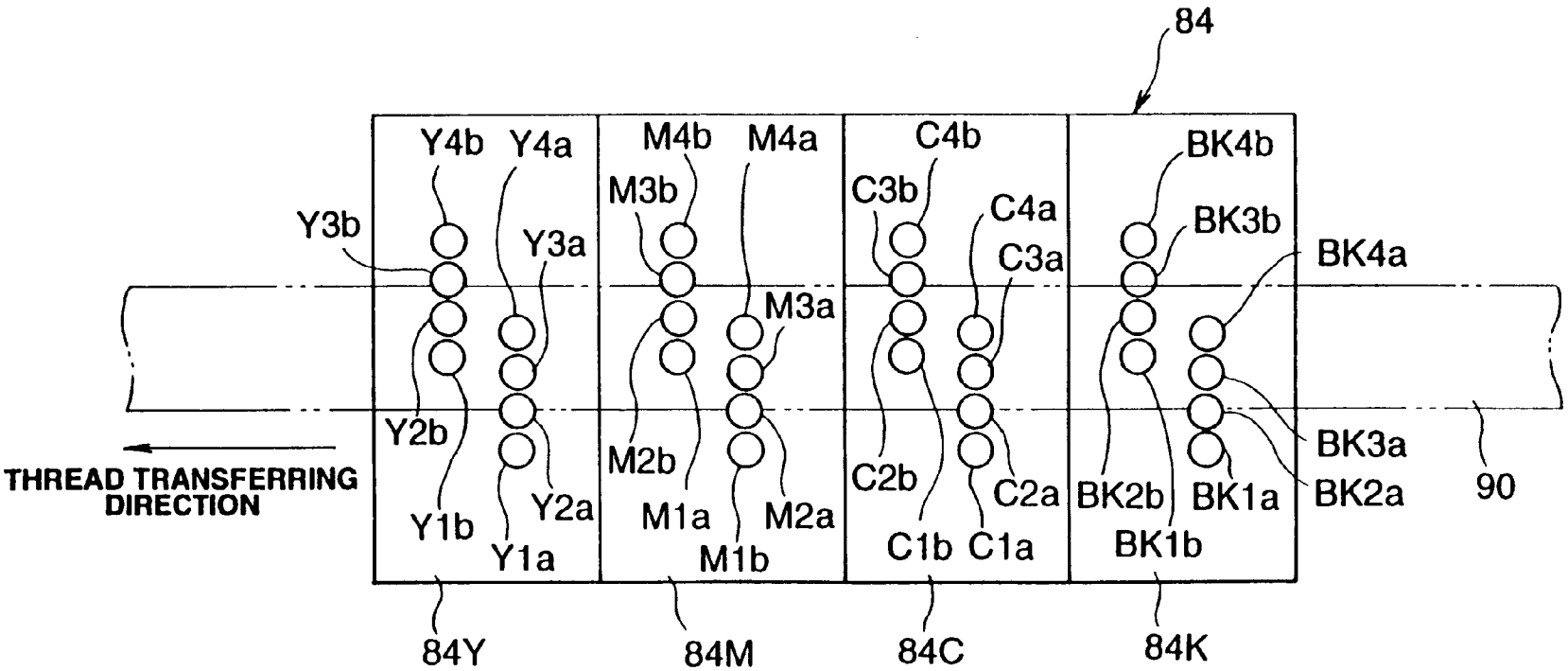
FIG. 17 illustrates printing on a thread by further modified ink jet heads according to the present invention.

FIG. 17 is a variation of the embodiment shown in FIG. 16. In this embodiment, a thread guiding member (not shown) faces the ink jet printing unit 84 (with heads 84K, 84C, 84M and 84Y) and is constructed such that the longitudinal axis of the thread coincides with the longitudinal center of the ink jet unit regardless of thread size. In addition, multiple nozzles eject ink onto the center portion of the thread since it is thicker there and will absorb more ink. According to this embodiment, suitable ink jet printing for various size threads can be performed.

Figure 18:
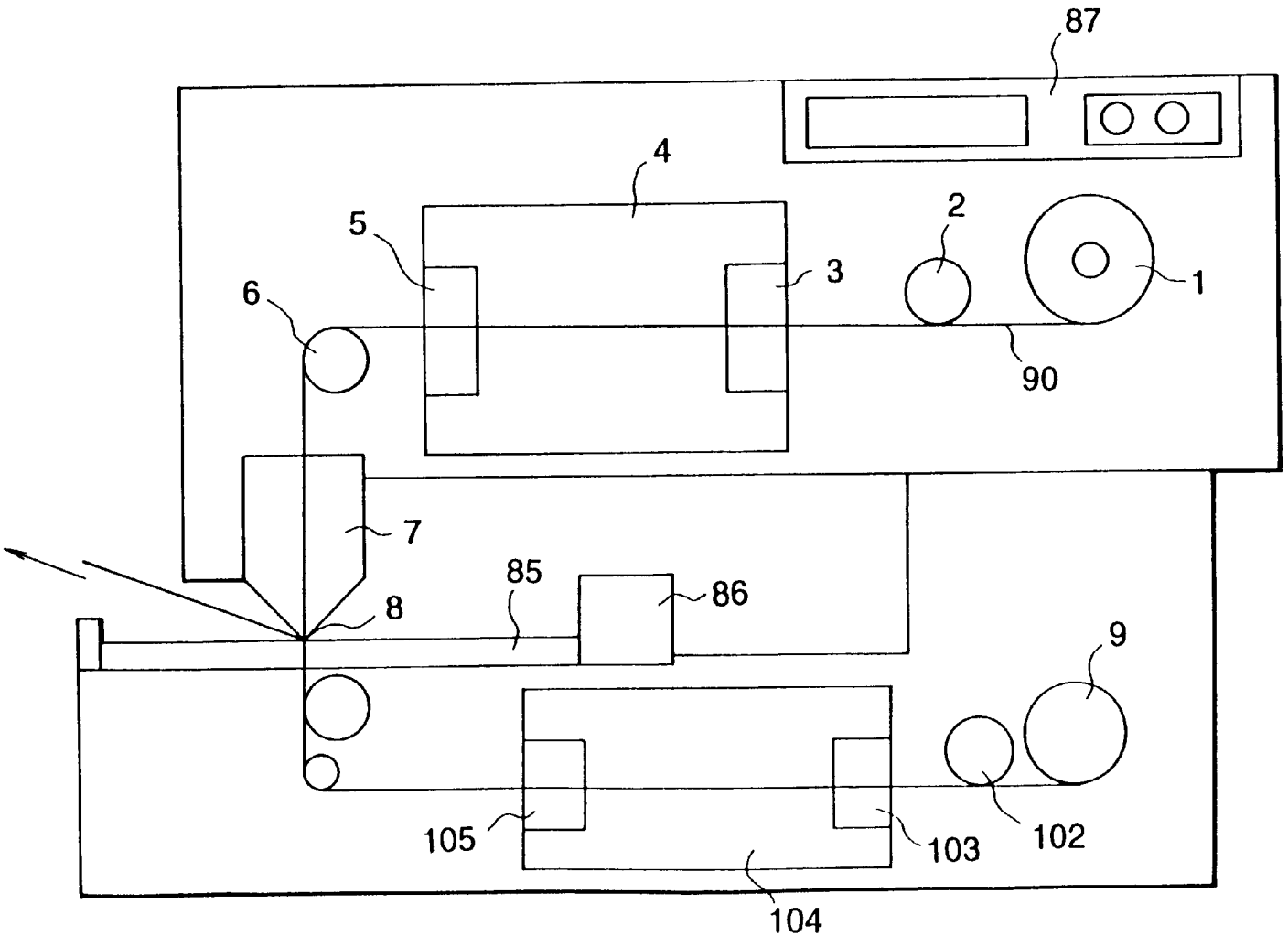
FIG. 18 in a schematic diagram of another embodiment of an embroidery apparatus according to the second aspect of the invention.

In the above-mentioned embodiments, a mono-color lower thread is used; however, as shown in the modified embodiment in FIG. 18, an ink jet printing unit 104 can be provided to discharge ink onto the lower thread so that various colors of embroidery can be performed on both sides of the base cloth. The lower thread is also passed through a pre-treatment unit 103 and a post-treatment unit 105, similar to the upper thread. In addition, a roller 102 includes a rotary encoder, as discussed above in connection with FIG. 8, to ensure that the embroidery with the lower thread is initiated at the proper point.

The present invention brings about excellent effects particularly in using a print head of the bubble jet system proposed by Canon Inc., which performs printing by forming fine ink droplets by the use of thermal energy.

As a representative constitution and principle, for example, the basic principle disclosed in, for example, U.S.

Pat. Nos. 4,723,129 and 4,740,796 is preferred. Particularly, on-demand type printing is effective because, by applying at least one driving signal which gives rapid temperature elevation exceeding nucleate boiling, electricity-heat converters, arranged corresponding to sheets or liquid channels holding a liquid (ink), generate thermal energy to effect film boiling at the heat acting surface of the recording head. Consequently, bubbles with the liquid (ink) can be formed in one-to-one correspondence to the driving signals. By discharging the liquid (ink) through an opening for discharging by growth and shrinkage of the bubble, at least one droplet is formed. By making the driving signals into desired pulse shapes, growth and shrinkage of the bubbles can be effected in a manner that discharges the liquid (ink) with particularly excellent response characteristics.

As the driving signals of such pulse shape, those disclosed in U.S. Pat. Nos. 4,463,359 and 4,345,262 are suitable. Further excellent recording can be performed using the conditions described in U.S. Pat. No. 4,313,124 concerning the temperature elevation rate of the abovementioned heat acting surface.

As the constitution of the recording head, in addition to the combination of the discharging port, liquid channel, and electricity-heat converter (linear liquid channel or right-angled liquid channel) as disclosed in the above-mentioned respective specifications, the constitution shown in U.S. Pat. Nos. 4,558,333 or 4,459,600, disclosing the heat acting portion arranged in a flexed region, is also included in the present invention.

In addition, the present invention can also effectively use the constitution disclosed in Japanese Laid-Open Patent Application No. 59-123670, which uses a slit common to a plurality of electricity-heat converters as the discharging portion of the electricity-heat converter, or Japanese Laid-Open Patent Application No. 59-138461, which has an opening for absorbing a pressure wave from the heat energy corresponding to the discharging portion.

In addition, the present invention is effective for a recording head of the freely exchangeable chip type, which enables electrical connection to the main device or supply of ink from the main device by being mounted on the main device, or a recording head of the cartridge type having an ink tank integrally provided on the recording head itself.

Also, addition of a restoration means for the recording head, a preliminary auxiliary means, etc., provided as the constitution of the recording device of the present invention is preferable, because the effect of the present invention can be further stabilized. Specific examples of these may include, for the recording head, capping means, cleaning means, pressurization or suction means, electricity-heat converters or another type of heating elements, or preliminary heating means according to a combination of these, and it also effective for performing stable recording to perform preliminary made which performs discharging separate from recording.

In addition, though the ink is considered as the liquid in the embodiments as above described, the ink may be in a solid state below room temperature as long as the ink will soften or liquify at or above room temperature, or liquify when a recording signal is applied to it. It is common in such an ink jet device to control the viscosity of the ink to be maintained within a certain range for stable discharge by adjusting the temperature of ink in a range from 30 to 70° C.

In addition, in order to avoid the temperature elevation due to heat energy by positively utilizing the heat energy as the energy for the change of state from solid to liquid, or to prevent the evaporation of ink by using ink that is solid under normal storage conditions, ink having a property of liquefying only with the application of heat energy, such as liquefying with the application of heat energy in accordance with a recording signal and solidifying prior to reaching a recording medium, is also applicable in the present invention. In such a case, the ink may be held as liquid or solid in recesses or through holes of a porous sheet, which is placed opposed to electricity-heat converters, as described in Japanese Laid-Open Patent Application No. 54-56847 or No. 60-71260. The most effective method for the ink as above described in the present invention is based on film boiling.

Thread for ink jet textile printing should have the following properties:

(1) the capability of being colored with the ink at sufficient densities;
(2) a high ink dyeing rate;
(3) rapid drying of ink deposited on the thread;
(4) minimal irregular blurring of ink deposited on thread; and
(5) the capability of being smoothly conveyed through the printing apparatus.

To meet these requirements, the thread may be pretreated as necessary to improve its suitability for ink jet printing by incorporating in the apparatus means for adding a pre-treatment agent to the thread. For example, U.S. Pat. No. 4,725,849 discloses several kinds of cloth having an ink receiving layer and Japanese Patent Publication No. 3-46589 discloses cloth containing a reduction inhibitor and/or alkaline substances. Examples of such pre-treatment include treating the cloth to contain a substance selected from an alkaline substance, water soluble polymer, synthetic polymer, water soluble metallic salt, urea and thiourea.

Examples of suitable alkaline substances include alkaline metal hydroxides such as sodium hydroxide and potassium hydroxide, amines such as mono, di-, or triethanolamine, and carbonic acid or alkaline metal carbonates and sodium bicarbonate. Further, they can include organic acid metallic salts, such as calcium acetate and barium acetate, and ammonia and ammonium compounds. Also, sodium trichloroacetate which becomes alkaline under dry heating may be used. Particularly, preferable alkaline substances may be sodium carbonate and sodium bicarbonate for use in coloring of reactive dyes.

Examples of suitable water soluble polymers include starch substances such as corn and wheat flour, cellulose substances such as carboxymethyl cellulose, methyl cellulose and hydroxyethyl cellulose, polysaccharides such as sodium alginate, gum arabic, locust bean gum, tragacanth gum, guar gum, and tamarind seeds, protein substances such as gelatins and casein, and natural water soluble substances such as tannin and lignin.

Examples of suitable synthetic polymers include polyvinyl alcohol compounds, polyethylene oxide compounds, acrylic acid type water soluble polymers, and maleic anhydride type water soluble polymers. Among such polymers, polysaccharide polymers and cellulose polymers are preferable.

Examples of suitable water soluble metallic salts include compounds having a pH of 4 to 10, which make typical ionic crystals such as halides of alkaline metal and alkaline earth metal. Typical examples of such compounds include alkaline metals such as NaCl, $Na_2AO_4$, $KC_1$ and $CH_3COONa$, and alkaline earth metals such as $CaCl_2$ and $MgCl_2$. Among such salts, salts of Na, K and Ca are preferable.

The method of pre-treating the thread to contain any of the above-cited substances is not specifically limited, but may be normally any one of dipping, pad application, coating, and spray methods.

Further, since the textile printing ink applied to the thread for ink jet textile printing may adhere only to the surface of the thread when jetted onto it, the fixation process of fixing coloring matter (such as a dye) in the ink onto the fibers is subsequently preferably performed as previously described. Such fixation process may be any one of conventionally well-known methods, including, for example, a steaming method, or a thermofixing method, and if not using thread pretreated with alkali, an alkali pad steam method, an alkali blotch steam method, an alkali shock method, and an alkali cold fix method.

Further, the removal of unreacted dye and substances used in pre-treatment can be performed by washing the printing medium in water or hot water having neutral detergent dissolved therein, using means for washing the printing medium, by any of conventionally well-known methods after the fixing process. It is preferable to use any one of conventional well-known fixation processes (for the fixation of dye) jointly with the washing.

It will be appreciated that the present invention has been disclosed in connection with numerous preferred embodiments thereof. Modifications and alterations other than those specifically noted can be made without departing from the spirit or scope of the invention as delineated in the following claims.

What is claimed is:

1. An ink jet printing apparatus for printing an image using printing means to discharge ink onto a thread as said thread and said printing means move at a speed relative to each other, wherein said printing means includes plural ink-discharging nozzles arranged along a direction of relative movement between said thread and said printing means, and said thread being used to embroider a pattern, said apparatus comprising:

detecting means for detecting the speed of relative movement between said thread and said printing means;

discharge control means for controlling an amount of ink discharged from said printing means and deposited on said thread per unit time in accordance with the detected speed of relative movement between said thread and said printing means; and printing control means for controlling said printing means to discharge ink onto said thread in accordance with said pattern being embroidered using said thread and a condition determined by the diameter or the quality of said thread, wherein said printing control means controls a number of said nozzles used to discharge ink in accordance with the a speed of relative movement between said thread and said printing means.

2. An ink jet printing apparatus according to claim 1, wherein said printing means includes electrothermal converters for generating heat energy to eject droplets of ink toward said thread.

3. An embroidering apparatus comprising:

printing means for discharging ink to print on a thread;

scanning means for moving said thread and said printing relative to each other;

control means for controlling the discharge of ink from said printing means onto said thread in accordance with pattern information relating to a pattern to be embroidered using said thread;

embroidering means for moving said thread relative to an embroidering medium to embroider in said embroidering medium a pattern corresponding to the pattern information as said thread is printed; and means for varying a number of ink droplets deposited at a particular location along said thread by said printing means in accordance with a diameter of said thread.

4. An embroidering apparatus according to claim 3, further comprising means for correcting tension in said thread based on the pattern information and properties of said embroidering medium.

5. An embroidering apparatus according to claim 3, wherein a diameter of an ink droplet deposited on said thread by said printing means is smaller than a diameter of said thread so that any one portion of said thread can be printed by depositing plural ink droplets on said portion.

6. An embroidering apparatus according to claim 3, wherein said thread discharges ink using printing means including electrothermal converters for generating heat energy to eject droplets of ink toward said printing medium.

7. An embroidering apparatus according to claim 3, further comprising means for displaying an embroidery pattern in color and color designating means for changing a color in the embroidery pattern, wherein the pattern information is generated from the changed color.

8. An embroidering apparatus according to claim 3, wherein said printing means has plural nozzles for discharging different color inks, said nozzles being arranged along a direction in which said thread is conveyed relative to said printing means.

9. An embroidering apparatus according to claim 3, wherein said printing means has plural ink-discharging nozzles arranged at an angle to a direction in which said thread is conveyed relative to said printing means.

10. An ink jet printing method for printing an image using printing means to discharge ink onto a thread as said thread and said printing means move at a speed relative to each other, wherein said printing means includes plural ink-discharging nozzles arranged along a direction of relative movement between said thread and said printing means, said method comprising the steps of:

detecting the speed of relative movement between said thread and said printing means; and controlling an amount of ink discharged from said printing means and deposited on said thread per unit time in accordance with the detected speed of relative movement between said thread and said printing means, wherein said controlling step is performed by changing a number of nozzles used to discharge ink in accordance with the speed of relative movement between said thread and said printing means.

11. An ink jet printing method according to claim 10, further comprising the step of fixing the ink applied on said thread.

12. An ink jet printing method according to claim 11, further comprising the step of washing said thread after fixing the ink thereon.

13. An ink jet printing method according to claim 10, wherein said printing means includes electrothermal converters for generating heat energy to eject droplets of ink toward said thread.

14. An embroidering method comprising the steps of:

providing printing means for discharging ink to print on a thread as said thread moves at a speed relative to said printing means;

controlling the discharge of ink from said printing means onto said thread in accordance with pattern information relative to a pattern to be embroidered using said thread and a condition determined by the diameter or the quality of said thread;

detecting the speed of relative movement between said thread and said printing means;

controlling an amount of ink discharged from said printing means and deposited on said thread per unit time in accordance with the detected speed of relative movement between said thread and said printing means; and embroidering said thread onto an embroidering medium to form a pattern corresponding to the pattern information as said thread is printed.

15. An embroidering method according to claim 14, wherein said printing means includes electrothermal converters for generating heat energy to eject droplets of ink toward said thread.

16. An ink jet printing and embroidering apparatus comprising:

transferring means for transferring a thread to be embroidered on a base medium;

ink jet printing means for discharging ink onto said thread in accordance with pattern information as said thread is transferred relative to said printing means;

sensing means for sensing an amount of said thread that has been transferred relative to said ink jet printing means;

embroidery means for embroidering said thread onto the base medium to form a pattern corresponding to the pattern information; and detecting means for detecting an amount of thread non-usable for embroidering the pattern based on a distance said thread travels from said ink jet printing means to said embroidery means, wherein said ink let printing means includes plural ink discharging nozzles and electrothermal converters for generating heat energy to elect droplets of ink toward said thread.

17. An ink jet printing and embroidering apparatus according to claim 16, wherein said thread has an initial point printed in accordance with the pattern information so that said initial point is located at an end of said non-usable amount of thread and said embroidering means includes means for embroidering said non-usable amount of thread in a temporary pattern having a beginning point and an ending point so that said beginning point, said ending point and said initial point substantially coincide.

18. An ink jet printing and embroidering apparatus according to claim 17, wherein the pattern embroided according to the pattern information is superimposed over the temporary pattern.

19. An embroided product comprising a base medium having a pattern embroided thereon with an elongated thread having different colors printed along the length of said thread as it is embroidered, wherein said thread is printed in accordance with said pattern to be embroidered and embroidery characteristics determined by a condition of said base medium and said thread.

20. A method for dyeing a thread by an ink jet printing method and embroidering cloth using said dyed thread, comprising the steps of:

making dyeing data for dyeing said thread in accordance with embroidery pattern information corresponding to a pattern to be embroidered and embroidery characteristics determined by a condition of said cloth and said thread;

dyeing the thread by said ink jet method in accordance with said dyeing data; and guiding the dyed thread and embroidering the dyed thread in accordance with the embroidery pattern information.

21. A method according to claim 20, further comprising the step of determining the information of the amount of transferring the thread with a transfer amount detection means which comprises a detection portion for detecting an amount of rotation of a rotary body in contact with the thread and being rotatably supported and a calculation portion for calculating the amount of transferring the thread in accordance with the amount of rotation detected by said detection portion.

22. A method according to claim 21, further comprising the step of:

when starting embroidering, setting an origin to be a criterion for detecting an amount of transferring the thread on an ink jet dyeing portion, and provisionally embroidering on a cloth in accordance with a provisional embroidery pattern for provisionally embroidering the thread from a tip of a needle to be used for embroidery to said origin, wherein provisional embroidery pattern information is made in accordance with said embroidery pattern information so that a position on the cloth where embroidery is started and said origin are at a same position.

23. A method according to claim 22, further comprising the steps of:

presuming a characteristic with respect to the embroidery of the cloth and the thread in accordance with the amount of transferring the thread when provisionally embroidering; and changing a condition of the thread and dyeing data in accordance with said characteristic with respect to the embroidery of said cloth.

24. A method according to claim 21, wherein during said making step the dyeing data is made in accordance with the embroidery pattern information and information of the amount of transferring the thread.

25. A method according to claim 24, further comprising the step of detecting the amount of transferring the thread before making the dyeing data.

26. A method according to claim 20, wherein a diameter of an ink droplet is smaller than that of the thread, thereby enabling dyeing a same area of the thread with a plurality of ink droplets.

27. A dyeing and embroidery apparatus for dyeing a thread by an ink jet method and embroidering cloth using said dyed thread, comprising:

a transferring portion for transferring a thread;

an ink jet dyeing portion for dyeing the thread before embroidering by said ink jet method;

means for making dyeing data in accordance with embroidery pattern information showing a pattern to be embroidered and embroidery characteristics determined by a condition of said cloth and said thread;

an embroidery portion for embroidering said cloth in accordance with said embroidery pattern information;

means for guiding the thread to said embroidery portion after processing by process means; and controlling means for dyeing said thread by said ink jet dyeing portion in accordance with said dyeing data, after processing the dyed thread by the process means, and embroidering the processed thread by said embroidery portion.

28. An apparatus according to claim 27, further comprising:

means for changing a number of ink droplets to be discharged to a predetermined region of the thread in accordance with a thickness of the thread.

29. An apparatus according to claim 27, further comprising:

a display portion for displaying a pattern for embroidery;

a memory for storing a pattern to be embroidered; and color designation means for changing color information stored in said memory, wherein said dyeing data is made in accordance with the color information changed by said color designation means.

30. An apparatus according to claim 27, wherein said ink jet dyeing portion has a number of nozzles corresponding to a plurality of colors along a direction of transferring a thread.

31. An apparatus according to claim 27, wherein said ink jet dyeing portion has a plurality of nozzles with different amounts of discharged ink along a direction of transferring a thread.

32. An apparatus according to claim 27, wherein said ink jet dyeing portion has a plurality of discharging openings, and said plurality of discharging openings are arranged tilting to a direction of transferring a thread.

33. An apparatus according to claim 27, further comprising:

means for changing a ratio of ink droplets to be discharged from said ink jet dyeing portion in accordance with a dyeing pattern where a density is variable in small areas or a dyeing pattern showing a ratio of mingling a plurality of colors in the thread.

34. An apparatus according to claim 27, further comprising:

means for setting a number of ink droplets to be discharged to a length of the thread to be dyed or a predetermined amount of the thread in accordance with at least one of a condition among a condition of the thread to be used for embroidering, a thickness of the cloth and a thickness of the thread used for embroidering.

35. An apparatus according to claim 27, further comprising:

means for transferring the thread without dyeing a tip thereof and provisionally embroidering a part of the thread not embroidered to a position outside a region of the embroidery pattern.

36. An apparatus according to claim 27, wherein said ink jet dyeing portion dyes the thread using an ink jet head including electrothermal converters for generating heat energy to discharge ink.

37. A dyeing and embroidering apparatus for dyeing a thread by an ink jet method and embroidering, comprising:

means for transferring the thread to be embroidered to a cloth;

an ink jet dyeing portion for dyeing the thread by the ink jet method on demand to discharge an ink droplet having a diameter smaller than a thickness of the thread or less than half of a diameter of the thread;

means for making dyeing data in accordance with embroidery pattern information showing a pattern to be embroidered and a condition determined by the diameter or the quality of said thread; and an embroidery portion for embroidering the thread to the cloth;

wherein said ink jet dyeing portion dyes the thread in accordance with said dyeing data, and said embroidery portion embroiders the dyed thread which is transferred from said ink jet dyeing portion to the cloth in accordance with said embroidery pattern.

38. An apparatus according to claim 27, further comprising:

means for obtaining information of an amount of transferring the thread, wherein said making means makes the dyeing data in accordance with the embroidery pattern information and the information of the amount of transferring the thread.

39. An apparatus according to claim 27, further comprising:

transfer amount detection means for detecting an amount of transferring the thread by said transferring portion and determining the amount of transferring the thread from a detection result of said transfer amount detection means.

40. An apparatus according to claim 37, wherein the dyeing data is made in accordance with the embroidery pattern information and information of an amount of transferring of the thread.

41. An apparatus according to claim 40, further comprising means for detecting the amount of transferring the thread.

* * * * *

UNITED STATES PATENT AND TRADEMARK OFFICE

CERTIFICATE OF CORRECTION

PATENT NO. : 6,189,989 B1
DATED : February 20, 2001
INVENTOR(S) : Hirabayashi et al.

It is certified that error appears in the above-identified patent and that said Letters Patent is hereby corrected as shown below:

Column 1,
Line 31, "apparatus" should read -- apparatuses --.

Column 2,
Line 25, "comprised" should read -- comprises --.
Lines 64 and 65, "embroided" should read -- embroidered --.

Column 3,
Line 48, "in" should read -- is --.

Column 7,
Line 47, "patten" should read -- pattern --.

Column 8,
Line 18, "is same." should read -- are the same. --.

Column 9,
line 67, "is" should read -- of --.

Column 10,
Line 4, "not" should read -- not be --.

Column 11,
Line 11, "pattern," should read -- pattern, or --.

Column 13,
Line 52, "it" should read -- it is --.
Line 54, "preliminary made" should read -- a preliminary discharge mode --.

Column 14,
Line 36, "triethanolamine," should read -- tri-ethanolamine, --.

Column 15,
Line 50, "a" should be deleted.
Line 58, "printing" should read -- printing means --.

UNITED STATES PATENT AND TRADEMARK OFFICE

CERTIFICATE OF CORRECTION

PATENT NO. : 6,189,989 B1
DATED : February 20, 2001
INVENTOR(S) : Hirabayashi et al.

It is certified that error appears in the above-identified patent and that said Letters Patent is hereby corrected as shown below:

Column 16,
Line 14, "thread discharges ink using printing means" should read -- printing means for discharging ink to print on a thread --.
Line 15, "including" should read -- includes --.
Line 16, "printing medium." should read -- thread. --.

Column 17,
Line 29, "let" should read -- jet --.
Line 31, "elect" should read -- eject --.
Lines 43, 46 and 47, "embroided" should read -- embroidered --.

Column 20,
Line 15, "cloth;" should read -- cloth, --.

Signed and Sealed this

Twenty-fifth Day of December, 2001

*Attest:*

*Attesting Officer*

JAMES E. ROGAN
*Director of the United States Patent and Trademark Office*